US010991208B1

(12) United States Patent
Dutt et al.

(10) Patent No.: US 10,991,208 B1
(45) Date of Patent: Apr. 27, 2021

(54) GAMING SYSTEMS AND METHODS FOR ADAPTIVE SOCIAL DISTANCING

(71) Applicant: SG Gaming, Inc., Las Vegas, NV (US)

(72) Inventors: Ravi Dutt, Mays Landing, NJ (US); Karthikeyan Elangovan, St Albert (CA); Muthukumaran Palanichamy, Henderson, NV (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 16/894,237

(22) Filed: Jun. 5, 2020

(51) Int. Cl.
*G07F 17/32* (2006.01)

(52) U.S. Cl.
CPC ..... *G07F 17/3269* (2013.01); *G07F 17/3232* (2013.01); *G07F 17/3283* (2013.01)

(58) Field of Classification Search
CPC ..... G07F 17/3269; G07F 17/3232; G07F 17/3283; G07F 17/3223; G07F 17/3227; G07F 17/323; G07F 17/3234; G07F 17/3237; G07F 17/3239; G07F 17/3241
See application file for complete search history.

(56) References Cited

U.S. PATENT DOCUMENTS 5,618,232 A 4/1997 Martin
6,508,710 B1 1/2003 Paravia et al.
6,628,939 B2 9/2003 Paulsen
6,676,522 B2 1/2004 Rowe et al.
6,800,029 B2 10/2004 Rowe et al.
6,811,488 B2 11/2004 Paravia et al.
6,843,725 B2 1/2005 Nelson
6,923,724 B2 8/2005 Williams
6,926,609 B2 8/2005 Martin
6,931,131 B1 8/2005 Becker, Jr. et al.
6,935,958 B2 8/2005 Nelson
RE39,644 E 5/2007 Alcorn et al.
7,229,354 B2 6/2007 McNutt et al.
7,316,619 B2 1/2008 Nelson
7,437,147 B1 10/2008 Luciano, Jr.
7,510,474 B2 3/2009 Carter, Sr.
7,534,169 B2 5/2009 Amaitis et al.
(Continued)

OTHER PUBLICATIONS

Bohner, Tiana, "Las Vegas company creates tools for casinos to manage cleaning, social distancing", FOX5, May 12, 2020, From: https://www.fox5vegas.com/coronavirus/las-vegas-company-creates-tools-for-casinos-to-nanage-cleaning-social-distancing/article_89bcbfda-94d0-11ea-bd84-0b91fd83f72a.html (Year: 2020).*
(Continued)

*Primary Examiner* — Jasson H Yoo

(57) ABSTRACT

A gaming system comprises a plurality of gaming machines configured to conduct one or more games and a management computing device communicatively coupled to the gaming machines. The management computing device receives indication of a gaming session initiating at a first gaming machine of the gaming machines, identifies one or more gaming machines associated with the first gaming machine from the gaming machines, transmits a disable command to the one or more associated gaming machines that prevents the one or more gaming machines from initiating gaming sessions, and in response to determining that the gaming session at the first gaming machine has concluded, transmits an enable command to the one or more associated gaming machines that enables the one or more gaming machines to initiate gaming sessions.

21 Claims, 10 Drawing Sheets

(56) References Cited

U.S. PATENT DOCUMENTS

| | | | | |
|---|---|---|---|---|
| 7,577,847 | B2 | 8/2009 | Nguyen et al. | |
| 7,637,810 | B2 | 12/2009 | Amaitis et al. | |
| 7,701,344 | B2 | 4/2010 | Mattice et al. | |
| 7,801,736 | B1 | 9/2010 | Halbritter et al. | |
| 7,811,172 | B2 | 10/2010 | Asher et al. | |
| 7,828,654 | B2 | 11/2010 | Carter, Sr. | |
| 7,874,919 | B2 | 1/2011 | Paulsen et al. | |
| 7,927,211 | B2 | 4/2011 | Rowe et al. | |
| 8,064,889 | B2 | 11/2011 | Griswold et al. | |
| 8,070,604 | B2 | 12/2011 | Amaitis et al. | |
| 8,092,303 | B2 | 1/2012 | Amaitis et al. | |
| 8,152,634 | B2 | 4/2012 | Gagner et al. | |
| 8,162,750 | B2 | 4/2012 | Gagner et al. | |
| 8,162,756 | B2 | 4/2012 | Amaitis et al. | |
| 8,226,474 | B2 | 7/2012 | Nguyen et al. | |
| 8,235,816 | B2 | 8/2012 | Nelson | |
| 8,267,789 | B2 | 9/2012 | Nelson | |
| 8,267,792 | B2 | 9/2012 | Buchholz et al. | |
| 8,282,475 | B2 | 10/2012 | Nguyen et al. | |
| 8,282,490 | B2 | 10/2012 | Arezina et al. | |
| 8,392,506 | B2 | 3/2013 | Rowe et al. | |
| 8,504,617 | B2 | 8/2013 | Amaitis et al. | |
| 8,506,400 | B2 | 8/2013 | Amaitis et al. | |
| 8,613,658 | B2 | 12/2013 | Amaitis et al. | |
| 8,616,967 | B2 | 12/2013 | Amaitis et al. | |
| 8,616,981 | B1 | 12/2013 | Guinn et al. | |
| 8,622,842 | B2 | 1/2014 | Nguyen et al. | |
| 8,684,843 | B2 | 4/2014 | Arezina et al. | |
| 8,690,679 | B2 | 4/2014 | Amaitis et al. | |
| 8,696,443 | B2 | 4/2014 | Amaitis et al. | |
| 8,708,805 | B2 | 4/2014 | Amaitis et al. | |
| 8,727,881 | B2 | 5/2014 | Ansari et al. | |
| 8,858,323 | B2 | 10/2014 | Nguyen et al. | |
| 8,870,649 | B2 | 10/2014 | Carter, Sr. | |
| 8,870,657 | B2 | 10/2014 | Nelson | |
| 8,876,608 | B2 | 11/2014 | Shepherd et al. | |
| 8,944,916 | B2 | 2/2015 | Abouchar et al. | |
| 9,443,379 | B2 | 9/2016 | Abbott | |
| 9,542,797 | B2 | 1/2017 | Detlefsen et al. | |
| 9,721,427 | B2 | 8/2017 | Hilbert et al. | |
| 9,824,532 | B2 | 11/2017 | Abouchar et al. | |
| 9,836,919 | B2 | 12/2017 | Abbott | |
| 9,927,244 | B2 | 3/2018 | Nelson et al. | |
| 10,192,398 | B2 | 1/2019 | Hilbert et al. | |
| 10,339,759 | B2 | 7/2019 | Dicillo et al. | |
| 10,591,303 | B2 | 3/2020 | Nelson et al. | |
| 2004/0106454 | A1* | 6/2004 | Walker | G07F 17/3239 463/42 |
| 2005/0043072 | A1 | 2/2005 | Nelson | |
| 2006/0095790 | A1 | 5/2006 | Nguyen et al. | |
| 2007/0015584 | A1* | 1/2007 | Frenkel | G07F 17/3211 463/42 |
| 2007/0099697 | A1 | 5/2007 | Nelson | |
| 2008/0051198 | A1 | 2/2008 | Nelson | |
| 2009/0170596 | A1 | 7/2009 | Gagner et al. | |
| 2009/0239667 | A1 | 9/2009 | Rowe et al. | |
| 2009/0280910 | A1 | 11/2009 | Gagner et al. | |
| 2009/0305773 | A1 | 12/2009 | Gagner et al. | |
| 2010/0016052 | A1 | 1/2010 | Gagner et al. | |
| 2010/0093429 | A1 | 4/2010 | Mattice et al. | |
| 2011/0105208 | A1* | 5/2011 | Bickley | G07F 17/3239 463/13 |
| 2011/0143834 | A1 | 6/2011 | Guinn et al. | |
| 2012/0015735 | A1 | 1/2012 | Abouchar et al. | |
| 2013/0084973 | A1 | 4/2013 | Frady | |
| 2013/0090158 | A1 | 4/2013 | Hornik et al. | |
| 2013/0324219 | A1 | 12/2013 | Vann | |
| 2014/0228096 | A1 | 8/2014 | Detlefsen et al. | |
| 2014/0243080 | A1* | 8/2014 | Lindborg | G07F 17/3241 463/29 |
| 2014/0335944 | A1 | 11/2014 | Hornik et al. | |
| 2015/0105144 | A1 | 4/2015 | Abouchar et al. | |
| 2015/0194012 | A1 | 7/2015 | Hendrickson et al. | |
| 2016/0086442 | A1 | 3/2016 | Hilbert et al. | |
| 2017/0323523 | A1 | 11/2017 | Hilbert et al. | |
| 2018/0023955 | A1 | 1/2018 | Nelson et al. | |
| 2018/0075696 | A1 | 3/2018 | Abouchar et al. | |
| 2018/0209794 | A1 | 7/2018 | Nelson et al. | |
| 2018/0322731 | A1 | 11/2018 | Gagner | |
| 2019/0073869 | A1 | 3/2019 | Hilbert et al. | |
| 2019/0088086 | A1 | 3/2019 | Rajendran | |
| 2020/0118386 | A1 | 4/2020 | Abouchar et al. | |

OTHER PUBLICATIONS

"Cleaning and social distancing technology— ACRES 4.0", Casino Journal, May 5, 2020, Retrieved from: https://www.casinojournal.com/articles/93630-cleaning-and-social-distancing-technology-acres-40, 2 pages.

Bohner, Tiana, "Las Vegas company creates tools for casinos to manage cleaning, social distancing", FOX5, May 12, 2020, Retrieved from: https://www.fox5vegas.com/coronavirus/las-vegas-company-creates-tools-for-casinos-to-manage-cleaning-social-distancing/article_89bcbfda-94d0-11ea-bd84-0b91fd83f72a.html, 5 pages.

Legato, Frank, "Safe Return", Global Gaming Business Magazine, May 26, 2020, Retrieved from: https://ggbmagazine.com/article/safe-return/, 8 pages.

"Smart Space Demo", Acres 4.0, Retrieved on Jun. 3, 2020, Retrieved from: https://www.dropbox.com/s/typ52mvovij176o/SmartSpaceDemo_05.mp4?dl=0, 9 pages.

"Table Trac, Inc. Receives Positive Feedback on Its Dynamic Auto Social Distance Products Used in Recent Casino Reopenings", PR Newswire, Jun. 2, 2020, Retrieved from: https://www.prnewswire.com/news-releases/table-trac-inc-receives-positive-feedback-on-its-dynamic-auto-social-distance-products-used-in-recent-casino-reopenings-301069443.html, 2 pages.

"Table Trac's Automated Social Distancing on Electronic Gaming Machines Product Patent-Pending", PR Newswire, May 5, 2020, Retrieved from: https://www.prnewswire.com/news-releases/table-tracs-automated-social-distancing-on-electronic-gaming-machines-product-patent-pending-301053338.html, 2 pages.

* cited by examiner

GAMING SYSTEMS AND METHODS FOR ADAPTIVE SOCIAL DISTANCING

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2020, Scientific Games International, Inc.

FIELD

The present disclosure relates generally to gaming systems, apparatus, and methods and, more particularly, to dynamic monitoring and management of gaming machines in a gaming machine.

BACKGROUND

Gaming environments, such as casinos, typically include a plurality of gaming machines, tables, and other devices to give players visiting the gaming environment a choice of a plurality of games to play. The gaming devices may be organized within the gaming environment in an efficient manner to facilitate a relatively larger number of gaming devices to be deployed while maintaining walkways for players. For example, gaming machines having similar hardware and/or conducting the same game may be positioned together in 'banks' such that the gaming machines are substantially adjacent to each other within the bank of machines.

However, this cluster of gaming machines may also cause players to be positioned proximate to each other. At least some players (and governmental or regulatory bodies) may have concerns regarding positioning two or more potential strangers together closely, particularly in view of any potential health concerns (e.g., a contagious virus). Moreover, the concerns may also extend to the sanitization of gaming machines. That is, as one player ends a gaming session at a gaming machine, the gaming machine may then be immediately available for a second player to initiate a gaming session, which may result in the second player being exposed to the same surfaces of the gaming machine as the first player. Although gaming machines may be sanitized at regular intervals (e.g., every day or every half-day), these regular intervals may not be sufficient to protect players between these intervals.

As a result, a gaming operator may elect to incorporate 'social distancing' into the operation of its gaming environment. Social distancing may include both limiting how close players (and other people) are to each other as well as limiting contact with shared surfaces (e.g., button panels on gaming machines) until sanitization can occur. The organization of gaming environments present several challenges in meeting social distancing standards. For example, gaming machines may be too close to each other. Removing and/or relocating gaming machines may be labor intensive (particularly if the guidelines for social distancing change over time) and may cause additional social distancing problems if people simply fill the voids left by the removed or relocated gaming machines. In another example, as mentioned above, sanitization at regular intervals may not meet the demand for a particular gaming device. Increasing the number of staff that patrols and monitors the gaming devices to sanitize gaming devices may be beneficial, but the increase in staff may still not be able to reach each and every machine between gaming sessions.

Accordingly, systems and methods are needed for dynamic social distance monitoring of gaming environments with limited (if any) modification to the current layout of the gaming environments.

SUMMARY

According to one aspect of the present disclosure, a gaming system comprises a plurality of gaming machines configured to conduct one or more games and a management computing device communicatively coupled to the gaming machines. The management computing device receives indication of a gaming session initiating at a first gaming machine of the gaming machines, identifies one or more gaming machines associated with the first gaming machine from the gaming machines, transmits a disable command to the one or more associated gaming machines that prevents the one or more gaming machines from initiating gaming sessions, and in response to determining that the gaming session at the first gaming machine has concluded, transmits an enable command to the one or more associated gaming machines that enables the one or more gaming machines to initiate gaming sessions.

According to another aspect of the disclosure, a method for managing a plurality of gaming machines using a management computing device in communication with the plurality of gaming machines is provided. The method may be at least partially performed using logic circuitry of the management computing device. The method includes receiving indication of a gaming session initiating at a first gaming machine of the plurality of gaming machines, identifying one or more gaming machines associated with the first gaming machine from the plurality of gaming machines, transmitting a disable command to the one or more associated gaming machines, the disable command configured to prevent the one or more gaming machines from initiating gaming sessions, and in response to determining that the gaming session at the first gaming machine has concluded, transmitting an enable command to the one or more associated gaming machines, the enable command configured to enable the one or more gaming machines to initiate gaming sessions.

According to yet another aspect of the disclosure, a management computing device in communication with a plurality of gaming machines is provided. The management computing device comprising logic circuitry that receives indication of a gaming session initiating at a first gaming machine of the plurality of gaming machines, identifies one or more gaming machines associated with the first gaming machine from the plurality of gaming machines, transmits a disable command to the one or more associated gaming machines, the disable command configured to prevent the one or more gaming machines from initiating gaming sessions, and in response to determining that the gaming session at the first gaming machine has concluded, transmits an enable command to the one or more associated gaming machines, the enable command configured to enable the one or more gaming machines to initiate gaming sessions.

Additional aspects of the disclosure will be apparent to those of ordinary skill in the art in view of the detailed description of various embodiments, which is made with reference to the drawings, a brief description of which is provided below.

Figure 1:
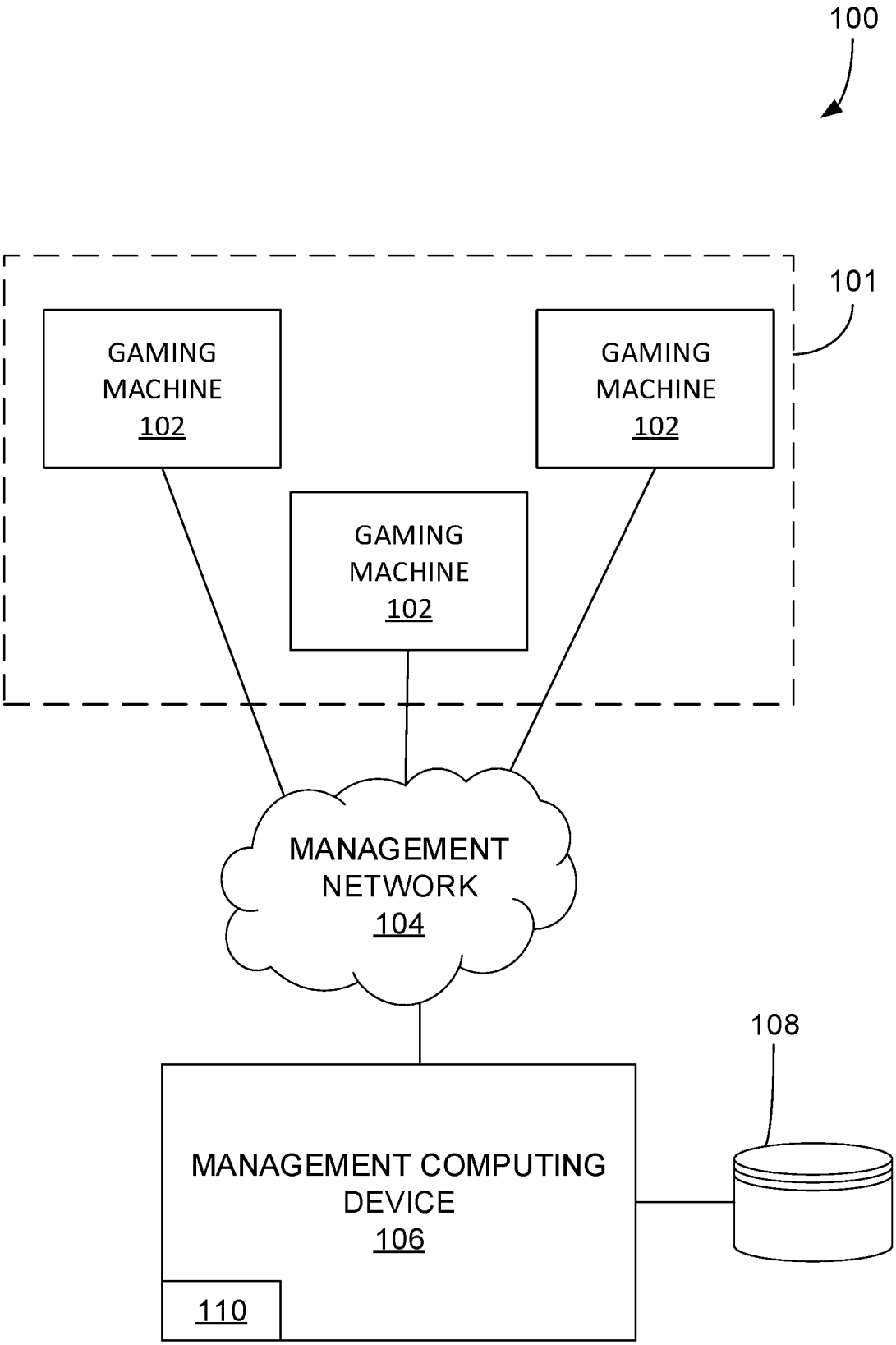
FIG. 1 is a block diagram of an example gaming system with a management computing device according to one or more embodiments of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games. It is to be understood that the games described herein are not limited to wagering games. Rather, the games may also include games having no wagers whatsoever.

The systems and methods described herein facilitate dynamic monitoring and management of gaming machines (and/or other gaming devices) in a gaming environment. That is, when a gaming session is detected at a first gaming machine, the systems and methods described herein automatically transmit a disable command to one or more gaming machines near the first gaming machine. This disable command causes the gaming machines to enter an operating state in which the gaming machines prevent any gaming sessions from being initiated (i.e., other players cannot play on these gaming machines while they are disabled). As a result, the player can play at the first gaming machine without violating social distancing guidelines, and the operator of the gaming environment was not required to remove or relocate the disabled gaming machines. Once the gaming session at the first gaming machine is complete, the disabled gaming machines may be enabled (i.e., the gaming machines are available for subsequent gaming sessions) and/or a sanitization procedure may be initiated in which the gaming machines are enabled after sanitization.

The dynamic nature of the systems and methods described herein enables the gaming environment to adapt to its current conditions and the current social distancing guidelines in real time. Moreover, the disable and enable commands are not merely notifications for a staff member to manually disable or enable a gaming machine, but rather a technical solution for a centralized system to adapt the gaming environment by changing the current operational state of the gaming machines.

FIG. 1 is a block diagram of an example gaming system 100 according to one or more embodiments of the present disclosure. The system 100 includes a plurality of gaming machines, a monitoring network 104, a management computing device 106, and a machine database 108. In other embodiments, the system 100 may include additional, fewer, or alternative devices, including those described elsewhere herein. For example, the system 100 may include other gaming devices (e.g., shufflers, terminals, kiosks, etc.) beyond gaming machines.

The gaming machines 102 are configured to conduct one or more games, such as casino wagering games. Examples of gaming machines are described in detail herein, particularly in FIGS. 5-6B. The gaming machines 102 are physically deployed in a gaming environment 101, such as a casino floor. In certain embodiments, the gaming machines 102 may be deployed in a plurality of gaming environments 101 such that the management computing device 106 is configured to manage multiple gaming environments 101.

The gaming machines 102 may be configured to operate in a plurality of states. Each operational state may be defined by the current functionality of the gaming machine 102. For example, and without limitation, the gaming machines 102 may have an idle state when waiting for a player to initiate a gaming session, an active state while a gaming session is active, a bonus game state, a maintenance state, a sanitization state, and/or a disabled state as described herein. These operational states may explicitly defined such that changes to the operational state are done by issuing an operational state command to switch between states. The operational state command may cause one or more underlying parameters to change according to the requested operational state. These parameters may include, and are not limited to, selectively enabling or disabling components, changes to presentation elements (e.g., lighting presentations, display animations, audio elements, etc.), selectively loading software elements, such as game software, and/or selective generation and transmission of messages. In other embodiments, the operational states are not explicitly defined, but rather the underlying parameters are changed directly to switch between states. For example, the gaming machine 102 may switch between an idle operational state to an active operational state by initiating the game, which implicitly represents the change from the idle state to the active state.

To establish a gaming session at a gaming machine 102, a player may physically approach the gaming machine and provide, for example, user input, credit input, card input, and/or the like. For example, the player may insert a card, ticket, bill, or coin into the gaming machine 102 to initiate a gaming session. Once established, the gaming session may continue until the player elects to conclude the gaming session or one or more termination conditions have been met. For wagering games, the gaming machines 102 may present the player with currency, tokens, a ticket, or a card in response to the gaming session concluding. The gaming machine 102 may be configured to generate game data, accounting data, and the like associated with the gaming session. The generated data may be transmitted via one or more networks (e.g., the management network 104) to one or more servers to monitor events from the gaming session. For example, accounting data may be generated and transmitted in response to wagers and/or awards within the gaming session.

The management network 104 is configured to facilitate communication between the gaming machines 102 and the management computing device 106. The management network 104 may include any suitable configuration of networking devices (e.g., routers, switches, wireless access points, modems, etc.) that facilitate data transmission between the gaming machines 102 and the management computing device 106. In certain embodiments, the management network 104 may be communicatively coupled to other devices to facilitate the functions of the management computing device 106 as described herein and/or to facilitate additional functions of the other devices. For example, the management network 104 may be communicatively coupled to a game server that communicates with the gaming machines 102 via the management network 104 to monitor game data and conduct game features at one or more gaming machines 102.

The management computing device 106 is communicatively coupled to the management network 104 to receive messages from the gaming machines 102 indicating the current statuses of the machines 102 and to issue command (e.g., operational state commands) to the gaming machines 102 based on the currents statuses. The management computing device 106 may be a centralized computing device or a distributed computing system in which the features and functionality of the management computing device 106 are spread across several communicatively coupled devices. In certain embodiments, the management computing device 106 may be incorporated within a management system that monitors and manages various aspects of one or more gaming environments. The management computing device 106 may be dedicated to the gaming environment 101 or associated with a plurality of gaming environments.

The management computing device 106 includes logic circuitry 110. The logic circuitry 110 includes one or more processors and memory devices in communication with the processors. The memory devices are configured to store computer-readable instructions that, when executed by the processors, cause the management computing device 106 to operate as described herein. In at least some embodiments, the logic circuitry 110 may include additional components, such as communication devices, data storage devices, and the like. The elements of the logic circuitry 110 may be centralized or distributed.

In the example embodiment, the logic circuitry 110 stores a plurality of operational state commands for the gaming machines 102. More specifically, the operational state commands include at least a disable command and an enable command. The disable command, when transmitted to a gaming machine 102, causes the gaming machine 102 to enter a disabled operational state as described in detail further below. The enable command causes the gaming machine 102 to transition from the disabled operational state to another state (e.g., resuming the previous operational state or to a predetermined state). These commands may include data to change one or more operational state parameters of the gaming machines 102, or the commands may be configured to change a plurality of parameters of the gaming machines 102 to cause the operational state change.

In the example embodiment, the operational state commands may be used to selectively disable one or more gaming machines 102 in response to initiating a gaming session at a gaming machine 102. That is, in response a gaming session being initiated at a first gaming machine, one or more gaming machines 102 associated with the first gaming machine are disabled. The association may be determined, for example, by the physical distance between gaming machines 102. More specifically, the associated gaming machines 102 are physically proximate to the first gaming machine.

The associating or linking of gaming machines 102 may be manually determined or automatically determined. These associations may be stored in the machine database 108 for retrieval by the logic circuitry 110. The machine database 108 may be part of the management computing device 106 (i.e., one or more data storage devices of the management computing device 106 are configured to store the data of the machine database 108) or the machine database 108 may be a separate device in communication with the management computing device 106. The machine database 108 may store a table of machine identifiers that are unique to each gaming machine 102 and any associated gaming machines 102 by linking the machine identifiers of the associated gaming machines 102 to the machine identifier of the respective gaming machine 102.

Although the term 'table' is used herein, it is to be understood that at least some embodiments may store the machine identifiers and/or other related data in other forms of data structures configured linked data elements together. Accordingly, these other data structures may be interchangeable with the 'tables' described herein. In another example, the machine database 108 may store a dynamic map of the gaming environment 101 and the locations of the gaming machines 102 within the gaming environment. The map may be used to establish an area of interest surrounding a gaming machine 102 to identify any associated gaming machines. In other embodiments, the management computing device 106 may use other suitable methods of tracking the physical locations of gaming machines 102 and, by extension, the physical distances between two gaming machines 102. For example, images captured by a plurality of cameras installed around the gaming environment may be used to identify each gaming machine 102 and its respective location.

Figure 2:
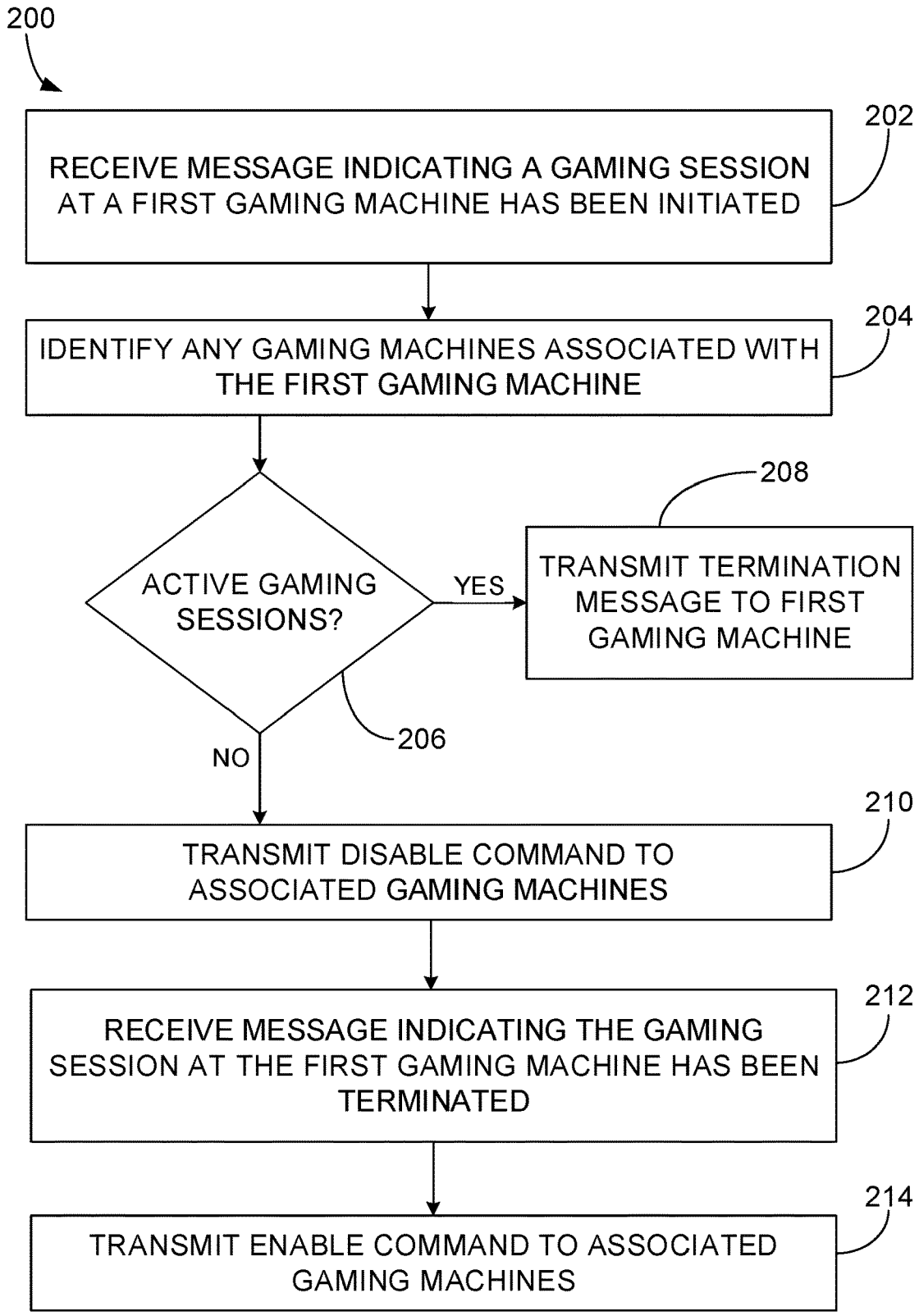
FIG. 2 is a flow diagram of an example method for monitoring a plurality of gaming machines according to one or more embodiments of the present disclosure.

FIG. 2 is a flow diagram of an example method 200 for managing a plurality of gaming machines using a gaming system, such as the system 100 shown in FIG. 1. The method 200 may specifically be used to enact social distancing and/or sanitization guidelines within a gaming environment without requiring the physical removal or relocation of gaming machines. The method 200 is at least partially performed by a management computing device (e.g., the management computing device 106, shown in FIG. 1) communicatively coupled to a plurality of gaming machines. In other embodiments, the method 200 may include additional, fewer, or alternative steps that may be performed by the management computing device or another suitable device, including those described elsewhere herein.

In the example embodiment, the management computing device receives 202 a message indicating a gaming session at a first gaming machine has been initiated. The first gaming machine may indicate the gaming session initiating by identifying an initiating event, such as a player providing user input, inserting a player card, and/or providing a credit input at the first gaming machine. In some embodiments, the initiation of a gaming session may be inferred from a credit meter at the first gaming machine. The message may be generated by the first gaming machine for the purpose of informing the management computing device and/or to notify another device. For example, a gaming server or an accounting server may also be notified of the gaming session being initiated. The message may be sent directly from the first gaming machine to the management computing device, or the management computing device may receive the message from an intermediary device. In certain embodiments, the management computing device may be configured to intercept messages between the first gaming machine and another device (e.g., a gaming server).

The management computing device then identifies 204 any gaming machines associated with the first gaming machine. In the example embodiment, the associated gaming machines are located physically proximate to the first gaming machine. Identifying 204 the associated gaming machines may be accomplished, for example, by the management computing device performing a lookup based on the machine identifier of the first gaming machine in a machine database (e.g., the machine database 108, shown in FIG. 1). In another example, the management computing device may establish an area of interest associated with the first gaming machine using a dynamic map of the gaming environment, and any gaming machines within the area of interest are associated with the first gaming machine.

The management computing device may determine 206 whether or not any of the associated gaming machines have ongoing or active gaming sessions. The determination 206 may be accomplished by requesting each associated gaming machine report their status or their current operational state. In other embodiments, the management computing device may perform a lookup in a database storing machine statuses or states (e.g., the machine database 108). If one or more associated gaming machines already have an active gaming session, the management computing device then transmits 208 a message to the first gaming machine to terminate the gaming session initiated at step 202. In some embodiments, the message is one or more commands recognized by the first gaming machine for terminating the gaming session and/or changing the operational state of the first gaming machine. For example, the first gaming machine may be switched to a disabled operational state that prevents a gaming session from being initiated (until the operational state is changed again).

The steps 206 and 208 are a safeguard against the gaming session at the first gaming machine violating the established social distancing guidelines if the first gaming machine has not already been commanded to enter a disabled operational state by the management computing device. However, in systems in which the association of gaming machines is symmetrical (i.e., if one gaming machine is associated with another gaming machine, then the latter gaming machine is also associated with the former gaming machine) and the distance relationship between gaming machine is dynamically updated, steps 206 and 208 may not be necessary. In such embodiments, the method 200 may proceed directly from step 204 to step 210.

If no active gaming sessions are detected, the management computing device transmits 210 a disable command to the associated gaming machines. In response to the disable command, the associated gaming machines transition for their current operational states (e.g., an idle state) to a disabled operational state. In the disabled operational state, the gaming machines prevent players from initiating gaming sessions. For example, a player may insert a player card or credit input at the gaming machine to initiate a gaming session. While the gaming machine is in the disabled operational state, the gaming machine may reject the player card or credit input. For example, the player card or credit input may be physically ejected for retrieval by the player without determining the player identifier or credit value. The disabled gaming machines may incorporate presentation elements into visually indicating to potential players that the machines are currently disabled. That is, lighting elements, audio elements, and/or graphical elements of the gaming machine may visually indicate that the gaming machine is not available for a gaming session. In one example, a display of the gaming machine may present a message explaining why a gaming session will not be initiated, and emotive lighting of the gaming machine may be disabled. The message and its corresponding graphical elements may be customized to stand out from the graphical game elements on the gaming machine.

The gaming session at the first gaming machine is conducted until the player elects to conclude the gaming session and/or one or more termination conditions (e.g., credit balance reaches zero with no additional credits provided, inactivity time exceeds a threshold time, etc.) have been met. In the example embodiment, the management computing device receives 212 a message indicating that the gaming session at the first gaming machine has been terminated. The message may be similar to the message received at step 202, and the determination of the gaming session concluding may be similar to the determination of a gaming session initiating. In response to the message, the management computing device transmits 214 an enable command to the associated gaming machines. The enable command causes the associated gaming machines to transition from the disabled operational state to another state. The gaming machines may resume the operational state that was active prior to the disable command, or the operational state may default to a predetermined state (e.g., an idle operational state). At this point, the associated gaming machines may be available for gaming sessions, and a player initiating a gaming session at a particular gaming machine may cause the method 200 to repeat. In certain embodiments, the enable command may be transmitted 214 after a delay to give the player at the first gaming machine the opportunity to walk away from the first gaming machine and/or enable sanitization of the first gaming machine to be performed.

In at least some embodiments, the method 200 may also include sanitization steps for the first gaming machine. That is, in response to the gaming session at the first gaming machine concluding, the management computing device may transmit a disable command to the first gaming machine to prevent players from initiating a subsequent gaming session until sanitization of the first gaming machine has been completed. In some embodiments, the management computing device does not transmit a disable command, but rather transmits a different operational state command. For example, the first gaming machine may have an operational state for sanitization that prevents gaming sessions from being initiated at the first gaming machine. The sanitization operational state may activate any automated components for sanitization (e.g., one or more UV lights pointed at likely areas of contact between the machine and players). The sanitization operational state causes the first gaming machine to adjust its presentation to visually indicate to potential players that the first gaming machine is not available for a gaming session.

The sanitization operational state may include a feature that requires an operator staff member to confirm completion of sanitization prior to switching to a different operational state. In one example, the management computing device or the first gaming machine generates a confirmation code for the first gaming machine. The confirmation code is stored by both the management computing device and the first gaming machine. The management computing device then notifies one or more computing devices associated with operator staff members that the first gaming machine needs to be sanitized. The notification may indicate the location, name, and/or other features of the first gaming machine to aid the operator staff members in identifying the first gaming machine. In certain embodiments, the first gaming machine may be configured to adjust its presentation elements to visually and/or audibly identify the first gaming machine to the operator staff members. The operator staff members may then sanitize the first gaming machine.

After the sanitization is complete, the operator staff members may confirm that the first gaming machine is ready for subsequent gaming sessions. In one example, the first gaming machine presents the confirmation code for the operator staff members to enter into a computing device in communication with the management computing device. The code may be presented in a text format or another suitable format, such as an optical or audible code that can be captured and/or decoded by the computing device of the operator staff members. In response to the management computing device receiving the confirmation code (and comparing the code to the stored confirmation code), the management computing device may transmit an enable command to the first gaming machine. In another example, the operator staff members input the confirmation code (either directly or via the computing device associated with the operator staff members) to the first gaming machine to confirm completion of sanitization. In yet another example, the operator staff members do not interface with the first gaming machine, but rather confirm sanitization is complete via communication between the computing device associated with the operator staff members and the management computing device. In certain embodiments, the enable command for the associated gaming machines may not be transmitted until confirmation of sanitization of the first gaming machine to enable the operator staff members to sanitize the first gaming machine away from players.

Figure 3:
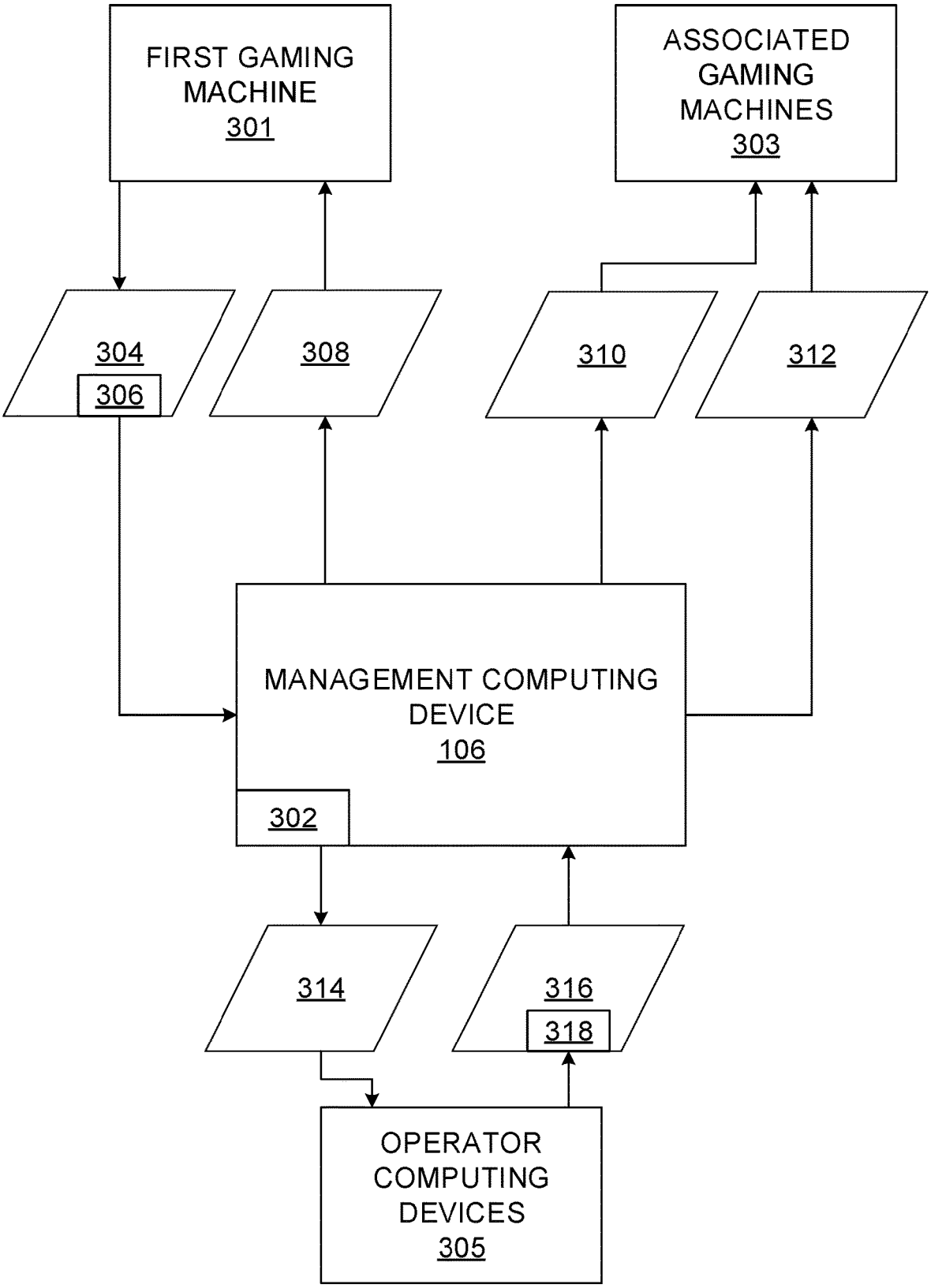
FIG. 3 is a data flow diagram of an example method for monitoring a plurality of gaming machines using the gaming system shown in FIG. 1 according to one or more embodiments of the present disclosure.

FIG. 3 is a data flow diagram of an example method for managing gaming machines using the system 100 shown in FIG. 1. The method may be substantially the same or similar to the method 200 shown in FIG. 2. The data flow includes the management computing device 106, a first gaming machine 301, one or more associated gaming machines 303, and one or more operator computing devices. The first gaming machine 301 and the associated gaming machines 303 are part of the plurality of gaming machines 102 shown in FIG. 1. The data described herein may be transmitted via the management network 104 (shown in FIG. 1) and/or another suitable network. In other embodiments, the data flow may include additional, fewer, or alternative data, including data described elsewhere herein. The data may be in any suitable format or configuration according to the data protocols defined by the communicating devices. For example, data communication may be configured according to protocols associated with a floor management system (SMS), casino management system (CMS), and/or other similar systems that facilitate networked data communication with gaming machines.

In the example embodiment, the management computing device 106 stores or has access to machine association data 302 (e.g., via a machine database, such as the database 108 shown in FIG. 1). The machine association data 302 indicates which, if any, gaming machines are associated with a particular gaming machine. The association may be based on physical proximity to the particular gaming machine and/or other suitable parameters. In one example, the machine association data 302 includes a table of machine identifiers that are linked together to indicate the association between the respective gaming machines. Each entry in the table may be associated with particular gaming machine. The entry may include several entry elements, such as, and without limitation, the machine identifier of the gaming machine, a location identifier for the gaming machine, and/or machine identifiers or location identifiers for associated gaming machines. The location identifiers may be used for gaming environments with predefined installation locations for gaming machines. These locations may include hardware for installing the machines (e.g., a stand or pedestal on which the gaming machine is installed), or may simply be a predefined location. Storing the location identifiers may enable the operator to define associations based on locations such that relocating gaming machines between location identifiers may automatically update which gaming machines are associated with a relocated gaming machine. An example of several entries is illustrated in Table 1, where each machine identifier is a four-digit value and each location identifier is a five-digit value. The second entry (machine identifier 3465) is not associated with any gaming machines or locations, and as a result, no identifiers are listed. The lack of association with other gaming machines may indicate that the gaming machine associated with the second entry is physically spaced apart from other gaming machines. In other embodiments, the table (or plurality of tables) that identify the gaming machine associations may have another suitable format, configuration, and/or combination of data elements.

TABLE 1

| Machine Identifier | Location Identifier | Assoc. Machine IDs | Assoc. Loc. IDs |
|---|---|---|---|
| 1234 | 12345 | 7890, 1292, 8541 | 67890, 85512, 01331 |
| 3465 | 24040 | — | — |

TABLE 1-continued

| Machine Identifier | Location Identifier | Assoc. Machine IDs | Assoc. Loc. IDs |
|---|---|---|---|
| 8333 | 11213 | 2548, 7890 | 13331, 67890 |
| 7890 | 67890 | 1234, 2548, 7890 | 12345, 13331, 67890 |

The initial associations between gaming machines may be manually defined (i.e., the operator selects or identifies which gaming machines or locations are associated with a given machine), or the operator may establish parameters for associating machines and/or locations together. For example, the operator may indicate a threshold distance from a gaming machine based on the type of gaming machine. In other embodiments, the associations may be at least partially automated. For example, updating the location of a gaming machine to may automatically update the associations in the table.

Figure 4:
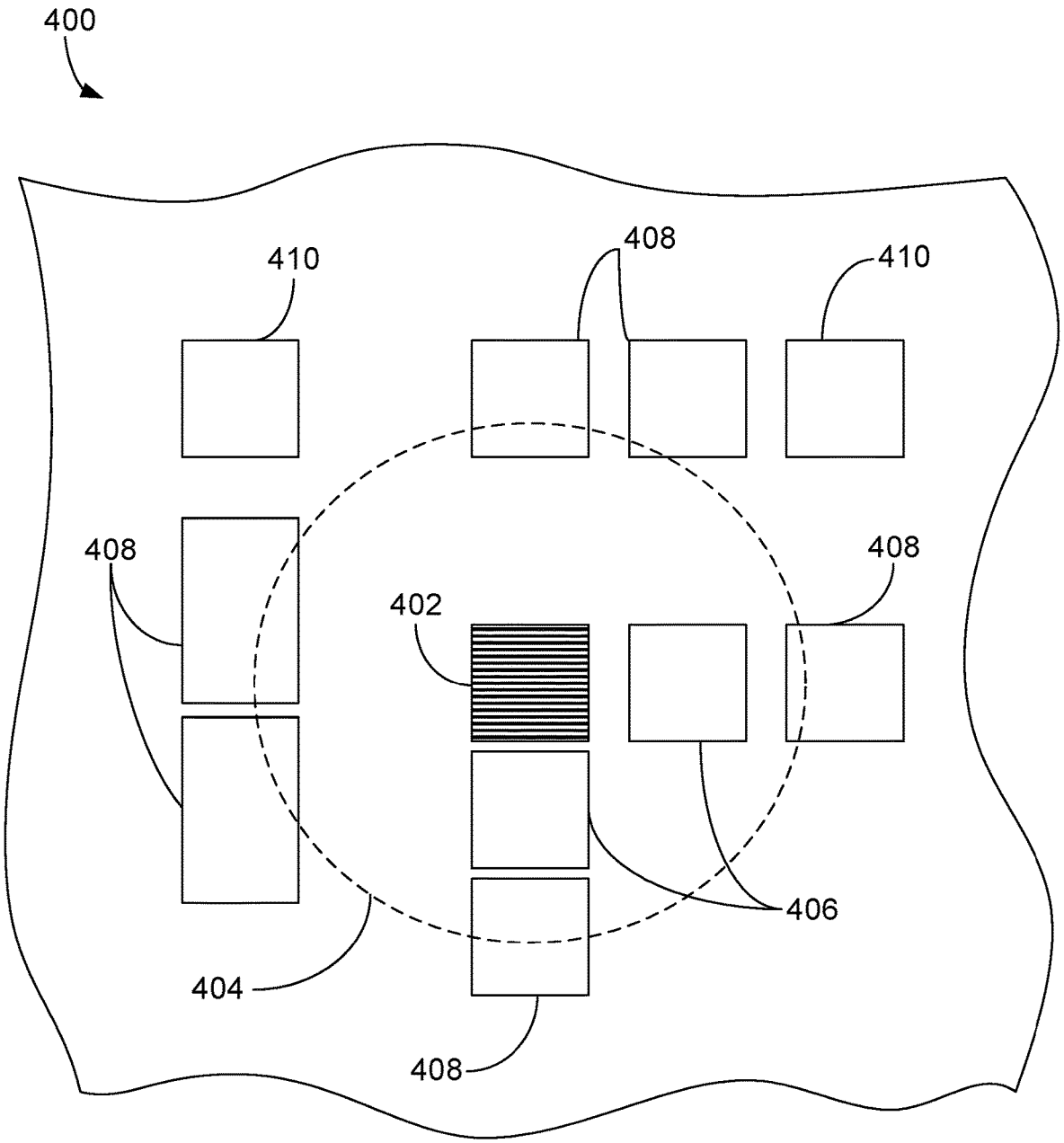
FIG. 4 is an example map diagram for dynamic determination of an area of interest surrounding a gaming machine according to one or more embodiments of the present disclosure.

In certain embodiments, the machine association data 302 may include a dynamic map to track associations between the gaming machines. FIG. 4 is a portion of an example map 400 of gaming machines within a gaming environment. In some embodiments, a graphical representation of the map 400 is stored by the management computing device 106 to determine gaming machine associations. In other embodiments, the map 400 is represented by parameters stored and updated by the management computing device 106 in response to location data of the gaming machines. In such embodiments, the graphical representation of the map 400 may be reconstructed using the stored parameters, thereby enabling the operator to manually review locations of the gaming machines and the associations between machines.

Location data for the gaming machines may be explicitly received by the management computing device 106, or the location data may be extracted from other data, such as image data of the gaming environment. In one example, the gaming machines may include Global Positioning System (GPS) modules for determining the respective machine's position. These GPS coordinates may be compared to each other to determine relative distances between gaming machines. In another example, the location data may be determined based signal strength, network connection points, and the like. In yet another example, one or more images of the gaming environment may be used to identify and locate the gaming machines within the gaming environment.

In addition to the location data of the gaming machines, the map 400 may include dimension data for each gaming machine. That is, if the dimensions of a gaming machine are known based on the type of gaming machine, the map 400 may scale the representation of the gaming machine to match or approximate the scaled dimensions of the real gaming machine. This enables the map 400 to provide relatively accurate approximations of the real location of the gaming machines rather than rely upon predetermined locations at which gaming machines are supposed to be installed (e.g., predetermined installation points).

Based on the location data, the dimension data, and the machine identifiers of each gaming machine, associations between gaming machines may be established using the map 400. The associations may be established during an initialization process for the management computing device 106 and updated in response to changes to the layout of gaming machines in the gaming environment. These associations may be stored (e.g., as machine association data 302) for the management computing device 106 to retrieve, or the associations may be determined in real-time. That is, in such embodiments, the management computing device 106 does not determine associations until a given gaming machine initiates a gaming session, and then the management computing device 106 may only determine the associated gaming machines for the given gaming machine. These real-time associations may be stored by the management computing device 106 for subsequent identification of the associated gaming machines or may be deleted to reduce the data storage burden of associating gaming machines on the management computing device 106.

In the example embodiment, to determine the associated gaming machines for a first gaming machine 402 on the map, an area of interest 404 is established. The area of interest 404 includes at least a physical area surrounding (and/or including) the first gaming machine 402. In the example embodiment, the area of interest 404 is a circle defined by a center point and a radial value. The center point may be established based on the location data and/or the dimension data of the first gaming machine 402, and the radial value may be defined by the operator based on the social distancing guidelines. In other embodiments, the area of interest 404 may not be circular and/or depend on different parameters of the first gaming machine 402. For example, the area of interest 404 may be rectangle or square. In another example, the area of interest 404 may not be a predefined shape, but rather extends outward from the first gaming machine 402 based on the dimensions and shape of the first gaming machine 402.

The radial value, center point, and/or other coordinates of the area of interest 404 (e.g., coordinates of the border of the area of interest 404) may be stored by the management computing device 106 or another suitable computing device in communication with the management computing device 106. These values and coordinates may be stored as the real-world values and/or a pixel or scaled values for the map 400. That is, a three meter radial value may be stored as three meters and/or as a scaled equivalent value of three meters for the map 400. The scaled value may be represented, for example, as a number of pixels relative to the scale of the map 400. It is to be understood that 'pixel coordinates' as described herein may be interchangeable with other coordinate systems that define locations within the map 400. For example, an imperial or metric-based coordinate system may be used.

After the area of interest 404 is established, gaming machine associated with the first gaming machine 402 based on proximity are identified. That is, gaming machines within the area of interest 404 may be considered associated with the first gaming machine 402. Any suitable techniques may be used to determining an intersection or overlapping of the gaming machines and the area of interest 404. For example, the management computing device 106 may be configured to step through a plurality of pixel coordinates within the area of interest 404 and comparing each pixel coordinate with pixel coordinates of the boundaries of the nearby gaming machines. The steps of pixel coordinates may represent, for example, pixel coordinates along one or more radii of the area of interest 404 and/or pixel coordinates of the boundary of the area of interest 404. The change between steps of pixel coordinates may be configured based on the computational and/or network resource burden of the comparison. That is, decreasing the number of steps in the comparison may reduce computational and/or network resource burden, thereby enabling the management computing device 106 to allocate computational and/or network resources to other functions. However, the number of steps may be configured to be sufficient to detect adjacent and nearby gaming machines to the first gaming machine 402 to a predetermined accuracy (e.g., within a half meter or within ten centimeters). If a gaming machine is determined at least partially occupies pixel coordinates within the pixel coordinates of the area of interest 404 based on the comparison, the gaming machine may be associated with the first gaming machine 402.

In the example embodiment, the comparison between the area of interest 404 and other gaming machines yield three different categories of gaming machines relative to the area of interest 404: (i) encompassed gaming machines 406, (ii) intersecting gaming machines 408, and (iii) external gaming machines 410. The management computing device 106 may distinguish between these three types by labeling the gaming machines, or the management computing device 106 may merely identify gaming machines associated with the first gaming machine 402 (and, as a result, implicitly define the remaining gaming machines as not associated with the first gaming machine 402). The encompassed gaming machines 406 are located within the area of interest 404 in their entirety, which means the encompassed gaming machines 406 may be within the distance range from the first gaming machine 402 indicated by social distancing guidelines. As a result, in the example embodiment, the encompassed gaming machines 406 are associated with the first gaming machine 402.

The intersecting gaming machines 408 are partially within the area of interest 404. In some embodiments, any intersection between the gaming machines 408 and the area of interest 404 may cause the management computing device 106 to identify the gaming machines 408 as associated with the first gaming machine 402. In other embodiments, the management computing device 106 may determine which, if any, intersecting gaming machines 408 are associated with the first gaming machine 402. For example, the management computing device 106 may determine, based on the comparison with the area of interest 404, if a majority of an intersecting gaming machine 408 is within the area of interest 404. In another embodiment, each gaming machine has a corresponding player area where the player sits or stands while playing at the gaming machine. In such embodiments, the management computing device 106 may associate an intersecting gaming machine 408 with the first gaming machine 402 if the player area of the intersecting gaming machine 408 is at least partially within the area of interest 404. Other suitable methods of identifying associated gaming machines from the intersecting gaming machines 408 may be used. The management computing device 106 may be configured to enable the operator to customize the comparison by defining one or more threshold parameters.

The external gaming machines 410 do not intersect or overlap the area of interest 404, and therefore are not associated with the first gaming machine 402. The external gaming machines 410 may not be explicitly defined by the management computing device 106 as the comparison between the area of interest 404 and the gaming machines ends at or substantially near the border of the area of interest 404.

Based on the comparison between the area of interest 404 and the gaming machines, the management computing device 106 may store a list of associated gaming machines for the first gaming machine 402. The list of associated gaming machines may include machine identifiers to facilitate communication with the associated gaming machines as described herein. In certain embodiments, the associations may be stored in a table, such as Table 1. To determine associations for each gaming machine, each gaming machine has a respective area of interest 404, and the management computing device 106 compares the respective area of interest 404 with adjacent and other nearby gaming machines for each gaming machine. These associations may be dynamic such that the management computing device 106 may update the map 400 and any affected associations in response to changes to the layout and configuration of gaming machines within the gaming environment. For example, the management computing device 106 may detect a change to the map 400, remove any associations that have changed (e.g., a gaming machine has been removed, and therefore is not associated with other gaming machines anymore), and identify any new associations. The dynamic and automatic functionality of management computing device 106 enables the social distancing and sanitization features described herein to operate with limited or no operator input, thereby reducing the potential risk of human error (e.g., incorrect or outdated associations between gaming machines).

With reference again to FIG. 3, in the example embodiment, a player attempts to initiate a gaming session at the first gaming machine 301. The first gaming machine 301 transmits an initiation message 304 to the management computing device 106 to indicate the attempt at initiating a gaming session. The initiation message 304 may include the machine identifier 306 of the first gaming machine 301. In certain embodiments, the initiation message 304 may not only be configured to notify the management computing device 106, but may have another function. For example, the initiation message 304 may also be transmitted to a gaming server or an accounting server to report the gaming session. In response to receiving the initiation message 304, the management computing device 106 extracts the machine identifier 306 to perform a lookup within the machine association data 302. In particular, the management computing device 106 performs the lookup to identify the associated gaming machines 303.

In at least some embodiments, the management computing device 106 may determine if any gaming sessions are active on the associated gaming machines 303. In one example, the management computing device 106 may request each associated gaming machine 303 report whether or not a gaming session is active, the status of the gaming machine 303, and/or the operational state of the gaming machine 303. In another example, the management computing device 106 may perform a lookup in a table or other suitable data structure storing the current status or state of each gaming machine 303. In certain embodiments, the machine database 108 (shown in FIG. 1) may store the status or state of the gaming machines 303. If a gaming session is active on the associated gaming machines 303, the management computing device 106 may transmit a termination message 308 to the first gaming machine 301 to terminate the gaming session initiated at the first gaming machine 301. The termination message 308 may include an operational state command to cause the first gaming machine 301 to transition to a different state to prevent subsequent gaming sessions, or the first gaming machine 301 may simply notify the player that a gaming session cannot be initiated at this time.

If the management computing device 106 determines the associated gaming machines do not have an active gaming session, then the gaming session at the first gaming machine 301 may proceed. To facilitate social distancing guidelines, the management computing device 106 transmits a disable command 310 to each of the associated gaming machines 303. The associated gaming machines 303 are configured to transition to a disabled operational state in response to the disable command 310. The disabled operational state may affect the operation of hardware and/or software of the associated gaming machines 303 to prevent any gaming session from being initiated at the associated gaming machines 303.

The gaming session at the first gaming machine 301 is conducted until the player concludes the gaming session or one or more termination conditions are met. The first gaming machine 301 may notify the management computing device 106 (e.g., via a message similar to the initiation message 304) that the gaming session has concluded. In response to the notification, the management computing device 106 may transmit an enable command 312 to the associated gaming machines 303 to cause the associated gaming machines to transition from the disabled operational state to another operational state, such as an idle state. In certain embodiments, the management computing device 106 may not transmit the enable command 312 until confirmation of the first gaming machine 301 being sanitized has been received.

In some embodiments, the first gaming machine 301 may transition to the disabled operational state or a sanitization state in response to the gaming session concluding to prevent players from initiating another gaming session prior to the first gaming machine 301 being sanitized. The first gaming machine 301 or the management computing device 106 may be configured to transmit a sanitization request 314 to one or more operator computing devices 305. The operator computing devices 305 are associated with one or more operator staff members tasked with sanitizing gaming machines. The operator computing devices 305 may be, for example, portable computing devices (e.g., a smartphone, tablet, etc.) that the operator staff member carries around the gaming environment. The sanitization request 314 may include information that enables the operator computing device 305 and/or the operator staff member to identify the first gaming machine 301. In one example, the sanitization request 314 may include the location identifier or coordinates of the first gaming machine 301, and a route to the first gaming machine 301 may be presented on the operator computing device 305. In certain embodiments, the first gaming machine 301 may use one or more presentation elements to distinguish the first gaming machine 301 from adjacent gaming machines.

Upon arriving at the first gaming machine 301, the operator staff member may conduct a sanitization process. To confirm completion of sanitization, the operator staff member may cause a confirmation message 316 to be transmitted to the management computing device 106 from the first gaming machine 301 and/or the operator computing device 305. In response to the confirmation message 316, the management computing device 106 transmits an enable command 312 (or a similar suitable command) to the first gaming machine 301 to transition the first gaming machine 301 from the sanitization or disabled operational state. The confirmation message 316 may include a confirmation code 318 for the management computing device 106 verify confirmation message 316. The confirmation code 318 may be any suitable data (e.g., text, optical code, audio code, etc.) that is generated and circulated for storage between the management computing device 106, the first gaming machine 301, and/or the operator computing device 305. Verification of the confirmation message 316 may include comparing the stored confirmation code 318 to the confirmation code 318 within the confirmation message 316. If the codes 318 are the same or substantially similar, the confirmation message 316 is authenticated, and the enable command 312 is transmitted to the first gaming machine 301. In certain embodiments, the operation computing device 305 may transmit the confirmation message to the first gaming machine 301, and the first gaming machine 301 automatically transitions from the sanitization or disabled operational state without involving the management computing device 106.

The foregoing systems and methods provide a technical solution within the technical field of gaming machine management. That is, the foregoing systems and methods facilitate dynamic social distancing and sanitization of a gaming environment with limited or no requirement of removing or relocating gaming machines and/or limited or no manual intervention. Selectively disabling and enabling hardware and/or software of the associated gaming machines may enable the foregoing systems and methods to limit or prevent players from violating social distancing guidelines in a way that manual intervention by operator staff may not achieve.

Figure 5:
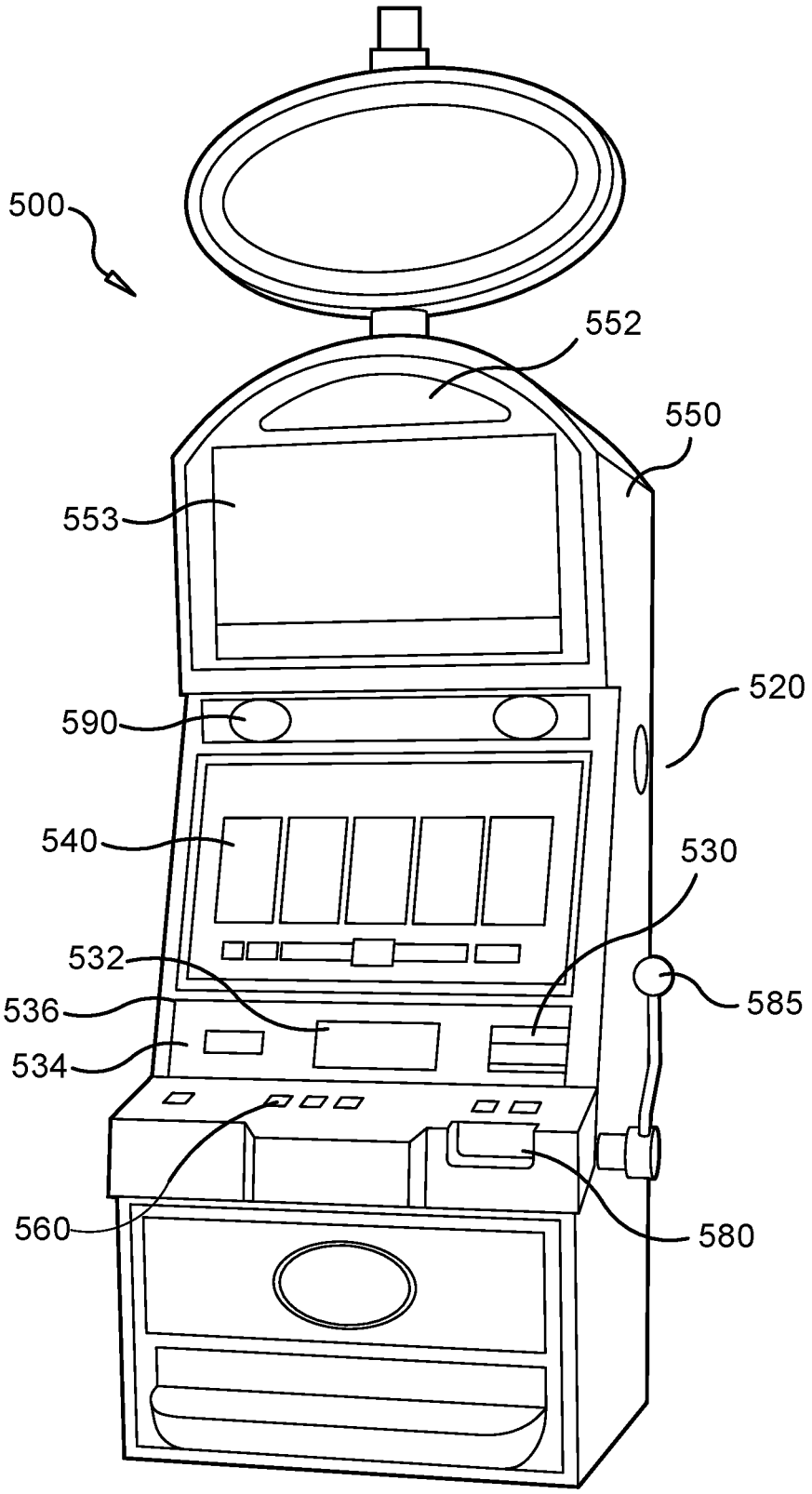
FIG. 5 is a perspective view of a gaming machine in accordance with one or more embodiments.

The following figures and description provide an example architecture for the foregoing systems. It is to be understood, however, that the following figures and description are for exemplary purposes only and that other suitable architectures may be used. Referring to FIG. 5, gaming machine 500 capable of supporting various embodiments of the invention is shown, including cabinet housing 520, primary game display 540 upon which a primary game and feature game may be displayed, top box 550 which may display multiple progressives that may be won during play of the feature game, player-activated buttons 560, player tracking panel 536, bill/voucher acceptor 580 and one or more speakers 590. Cabinet housing 520 may be a self-standing unit that is generally rectangular in shape and may be manufactured with reinforced steel or other rigid materials which are resistant to tampering and vandalism. Cabinet housing 520 may alternatively be a handheld device including the gaming functionality as discussed herein and including various of the described components herein. For example, a handheld device may be a cell phone, personal data assistant, or laptop or tablet computer, each of which may include a display, a processor, and memory sufficient to support either standalone capability such as gaming machine 400 or thin client capability such as that incorporating some of the capability of a remote server. Exemplary types of gaming machines are disclosed in U.S. Pat. Nos. 6,517,433, 8,057,303, and 8,226,459, which are incorporated herein by reference in their entireties.

In one or more embodiments, cabinet housing 520 houses a processor, circuitry, and software (not shown) for receiving signals from the player-activated buttons 560, operating the games, and transmitting signals to the respective displays and speakers. Any shaped cabinet may be implemented with any embodiment of gaming machine 500 so long as it provides access to a player for playing a game. For example, cabinet 520 may comprise a slant-top, bar-top, or table-top style cabinet, including a Bally Cinevision™ or CineReels™ cabinet. The operation of gaming machine 500 is described more fully below.

The plurality of player-activated buttons 560 may be used for various functions such as, but not limited to, selecting a wager denomination, selecting a game to be played, selecting a wager amount per game, initiating a game, or cashing out money from gaming machine 400. Buttons 460 may be operable as input mechanisms and may include mechanical buttons, electromechanical buttons or touch screen buttons. Optionally, a handle 585 may be rotated by a player to initiate a game.

In one or more embodiments, buttons 560 may be replaced with various other input mechanisms known in the art such as, but not limited to, a touch screen system, touch pad, track ball, mouse, switches, toggle switches, or other input means used to accept player input such as a Bally iDeck™. One other example input means is a universal button module as disclosed in U.S. application Ser. No. 11/106,212, entitled "Universal Button Module," filed on Apr. 14, 2005, which is hereby incorporated by reference. Generally, the universal button module provides a dynamic button system adaptable for use with various games and capable of adjusting to gaming systems having frequent game changes. More particularly, the universal button module may be used in connection with playing a game on a gaming machine and may be used for such functions as selecting the number of credits to bet per hand.

Cabinet housing 520 may optionally include top box 550 which contains "top glass" 552 comprising advertising or payout information related to the game or games available on gaming machine 500. Player tracking panel 536 includes player tracking card reader 534 and player tracking display 532. Voucher printer 530 may be integrated into player tracking panel 536 or installed elsewhere in cabinet housing 520 or top box 550.

Game display 540 may present a game of chance wherein a player receives one or more outcomes from a set of potential outcomes. For example, one such game of chance is a video slot machine game. In other aspects of the invention, gaming machine 500 may present a video or mechanical reel slot machine, a video keno game, a lottery game, a bingo game, a Class II bingo game, a roulette game, a craps game, a blackjack game, a mechanical or video representation of a wheel game or the like.

Mechanical or video/mechanical embodiments may include game displays such as mechanical reels, wheels, or dice as required to present the game to the player. In video/mechanical or pure video embodiments, game display 540 is, typically, a CRT or a flat-panel display in the form of, but not limited to, liquid crystal, plasma, electroluminescent, vacuum fluorescent, field emission, or any other type of panel display known or developed in the art. Game display 540 may be mounted in either a "portrait" or "landscape" orientation and be of standard or "widescreen" dimensions (i.e., a ratio of one dimension to another of at least 16×9). For example, a widescreen display may be 32 inches wide by 18 inches tall. A widescreen display in a "portrait" orientation may be 32 inches tall by 18 inches wide. Additionally, game display 440 preferably includes a touch screen or touch glass system (not shown) and presents player interfaces such as, but not limited to, credit meter (not shown), win meter (not shown) and touch screen buttons (not shown). An example of a touch glass system is disclosed in U.S. Pat. No. 6,942,571, entitled "Gaming Device with Direction and Speed Control of Mechanical Reels Using Touch Screen," which is hereby incorporated by reference in its entirety for all purposes.

Game display 540 may also present information such as, but not limited to, player information, advertisements and casino promotions, graphic displays, news and sports updates, or even offer an alternate game. This information may be generated through a host computer networked with gaming machine 500 on its own initiative or it may be obtained by request of the player using either one or more of the plurality of player-activated buttons 560; the game display itself, if game display 540 comprises a touch screen or similar technology; buttons (not shown) mounted about game display 540 which may permit selections such as those found on an ATM machine, where legends on the screen are associated with respective selecting buttons; or any player input device that offers the required functionality.

Cabinet housing 520 incorporates a single game display 540. However, in alternate embodiments, cabinet housing 520 or top box 550 may house one or more additional displays 553 or components used for various purposes including additional game play screens, animated "top glass," progressive meters or mechanical or electromechanical devices (not shown) such as, but not limited to, wheels, pointers or reels. The additional displays may or may not include a touch screen or touch glass system.

Figure 6A:
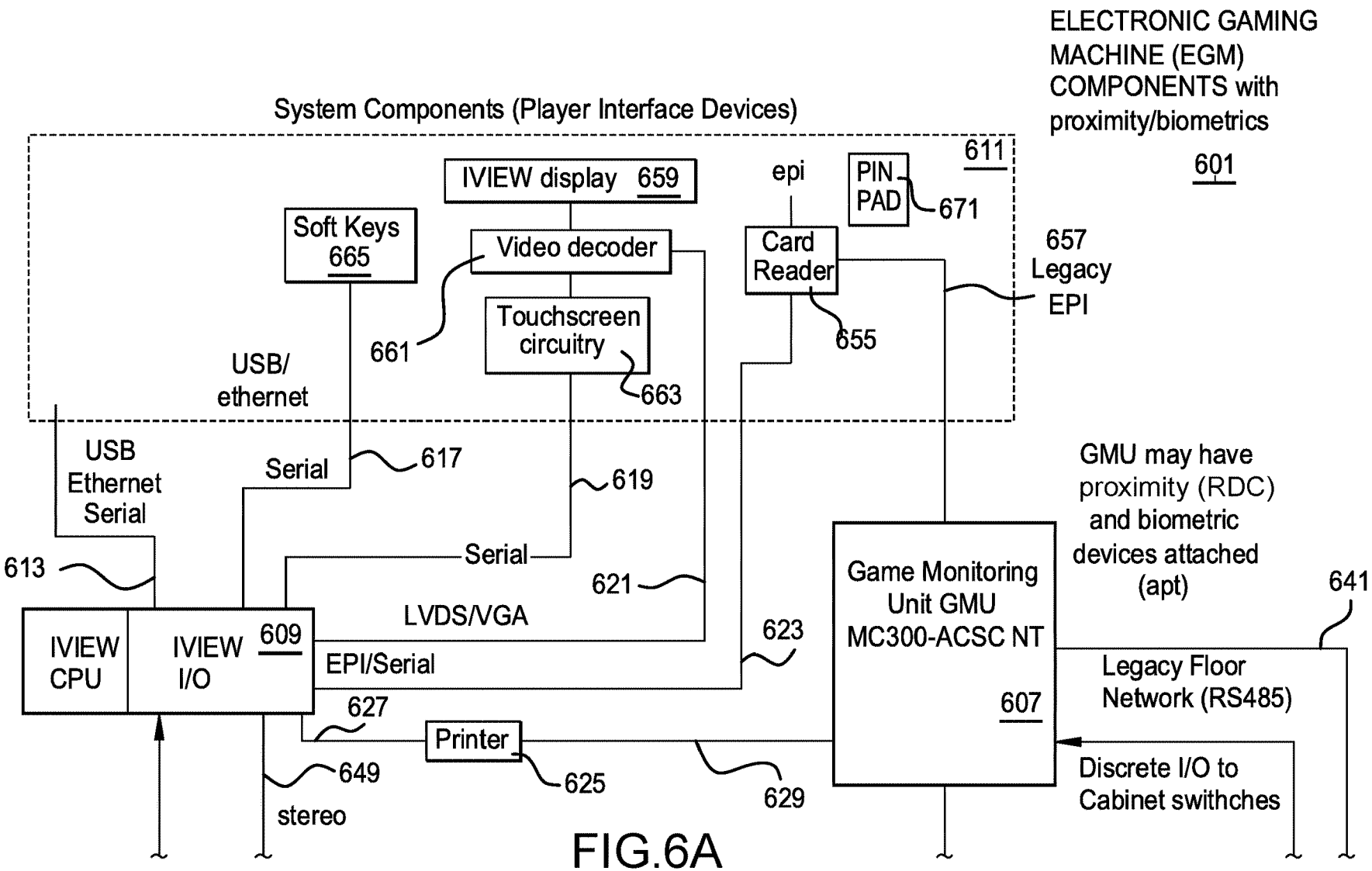
FIGS. 6A and 6B are a block diagram of the physical and logical components of the gaming machine of FIG. 5 in accordance with one or more embodiments.
Figure 6B:
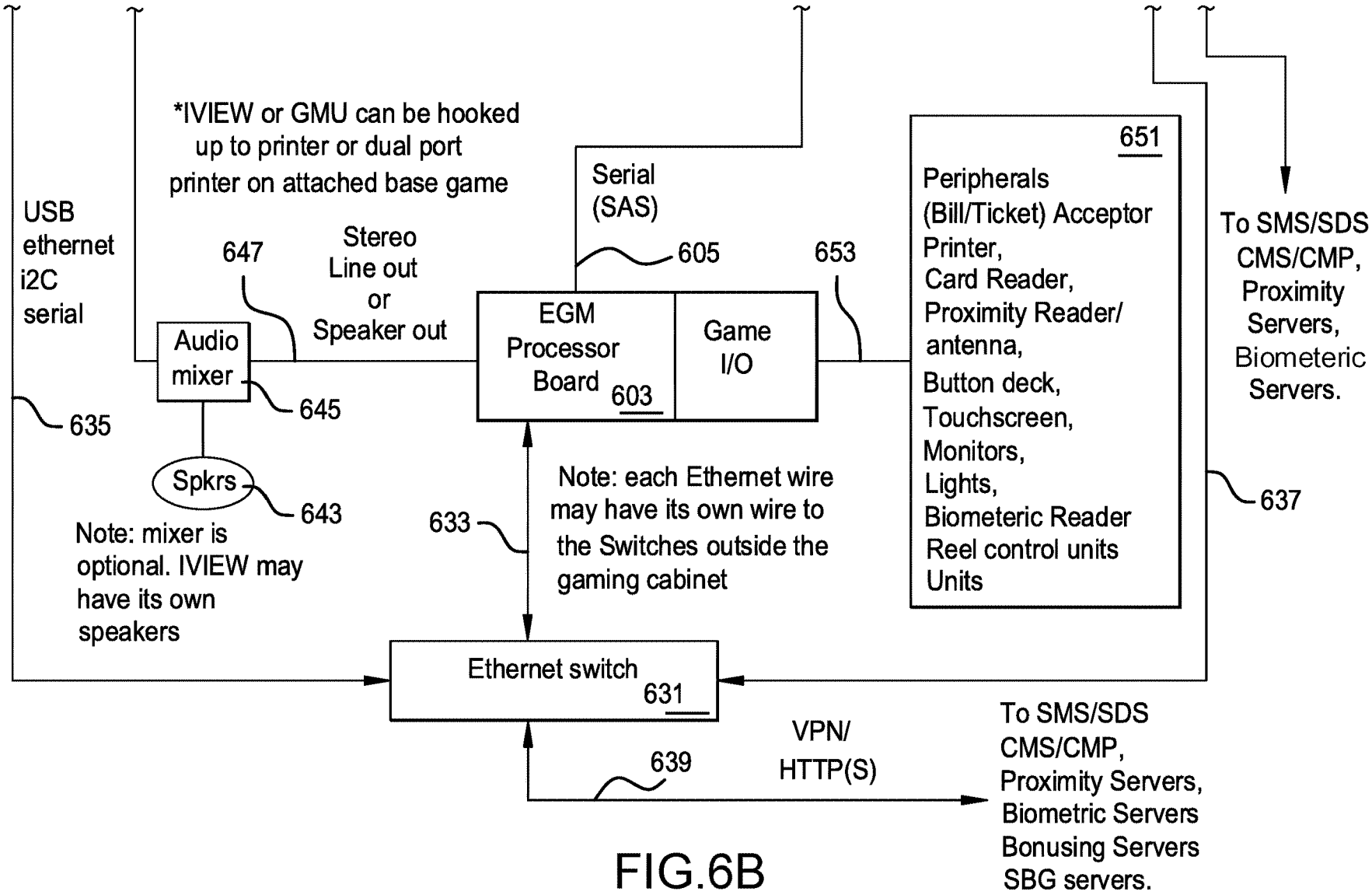

Referring to FIGS. 6A and 6B, electronic gaming machine 601 is shown in accordance with one or more embodiments. Electronic gaming machine 601 includes base game integrated circuit board 603 (EGM Processor Board) connected through serial bus line 605 to game monitoring unit (GMU) 1507 (such as a Bally MC300 or ACSC NT), and player interface integrated circuit board (PIB) 609 connected to player interface devices 611 over bus lines 613, 615, 617, 619, 621, 623. Printer 625 is connected to PM 609 and GMU 607 over bus lines 627, 629. Base game integrated circuit board 603, PIB 609, and GMU 607 connect to Ethernet switch 631 over bus lines 633, 635, 637. Ethernet switch 631 connects to a slot management system (SMS) and a casino management system (CMS) network over bus line 639. GMU 607 also may connect to the SMS and CMS network over bus line 641. Speakers 643 connect through audio mixer 645 and bus lines 647, 649 to base game integrated circuit board 603 and PIB 609. The proximity and biometric devices and circuitry may be installed by upgrading a commercially available PIB 609, such as a Bally iView unit. Coding executed on base game integrated circuit board 603, PIB 609, and/or GMU 607 may be upgraded to integrate a game according to one or more embodiments of the present invention, as is more fully described herein.

Peripherals 651 connect through I/O board 653 to base game integrated circuit board 603. For example, a bill/ticket acceptor is typically connected to a game input-output board 653 which is, in turn, connected to a conventional central processing unit ("CPU") base game integrated circuit board 603, such as an Intel Pentium microprocessor mounted on a gaming motherboard. I/O board 653 may be connected to base game integrated circuit board 603 by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include a gaming machine operating system (OS), such as a Bally Alpha OS. Base game integrated circuit board 603 executes a game program that causes base game integrated circuit board 603 to play a game. In one embodiment, the game program provides a slot machine game having adjustable multi-part indicia. The various components and included devices may be installed with conventionally and/or commercially available components, devices, and circuitry into a conventional and/or commercially available gaming machine cabinet, examples of which are described above.

When a player has inserted a form of currency such as, for example and without limitation, paper currency, coins or tokens, cashless tickets or vouchers, electronic funds transfers or the like into the currency acceptor, a signal is sent by way of I/O board 653 to base game integrated circuit board 603 which, in turn, assigns an appropriate number of credits for play in accordance with the game program. The player may further control the operation of the gaming machine by way of other peripherals 651, for example, to select the amount to wager via electromechanical or touch screen buttons. The game starts in response to the player operating a start mechanism such as a handle or touch screen icon. The game program includes a random number generator to provide a display of randomly selected indicia on one or more displays. In some embodiments, the random generator may be physically separate from gaming machine 600; for example, it may be part of a central determination host system which provides random game outcomes to the game program. Thereafter, the player may or may not interact with the game through electromechanical or touch screen buttons to change the displayed indicia. Finally, base game integrated circuit board 603 under control of the game program and OS compares the final display of indicia to a pay table. The set of possible game outcomes may include a subset of outcomes related to the triggering of a feature game. In the event the displayed outcome is a member of this subset, base game integrated circuit board 603, under control of the game program and by way of I/O Board 653, may cause feature game play to be presented on a feature display.

Predetermined payout amounts for certain outcomes, including feature game outcomes, are stored as part of the game program. Such payout amounts are, in response to instructions from base game integrated circuit board 603, provided to the player in the form of coins, credits or currency via I/O board 653 and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In one embodiment, the remote storage device is housed in a remote server. The gaming machine may access the remote storage device via a network connection, including but not limited to, a local area network connection, a TCP/IP connection, a wireless connection, or any other means for operatively networking components together. Optionally, other data including graphics, sound files and other media data for use with the EGM are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the EGM using USB, serial or Ethernet connections. Each of the respective devices may have upgrades to their firmware utilizing these connections.

GMU 607 includes an integrated circuit board and GMU processor and memory including coding for network communications, such as the G2S (game-to-system) protocol from the Gaming Standards Association, Las Vegas, Nev., used for system communications over the network. As shown, GMU 607 may connect to card reader 655 through bus 657 and may thereby obtain player card information and transmit the information over the network through bus 641. Gaming activity information may be transferred by the base game integrated circuit board 603 to GMU 607 where the information may be translated into a network protocol, such as S2S, for transmission to a server, such as a player tracking server, where information about a player's playing activity may be stored in a designated server database.

PIB 609 includes an integrated circuit board, PID processor, and memory which includes an operating system, such as Windows CE, a player interface program which may be executable by the PID processor together with various input/output (I/O) drivers for respective devices which connect to PIB 609, such as player interface devices 611, and which may further include various games or game components playable on PIB 609 or playable on a connected network server and PIB 609 is operable as the player interface. PIB 609 connects to card reader 655 through bus 623, display 659 through video decoder 661 and bus 621, such as an LVDS or VGA bus.

As part of its programming, the PID processor executes coding to drive display 659 and provide messages and information to a player. Touch screen circuitry interactively connects display 659 and video decoder 661 to PIB 609, such that a player may input information and cause the information to be transmitted to PM 609 either on the player's initiative or responsive to a query by PIB 609. Additionally soft keys 665 connect through bus 617 to PM 609 and operate together with display 659 to provide information or queries to a player and receive responses or queries from the player. PIB 609, in turn, communicates over the CMS/SMS network through Ethernet switch 631 and busses 635, 639 and with respective servers, such as a player tracking server.

Player interface devices 611 are linked into the virtual private network of the system components in gaming machine 601. The system components include the iView processing board and game monitoring unit (GMU) processing board. These system components may connect over a network to the slot management system (such as a commercially available Bally SDS/SMS) and/or casino management system (such as a commercially available Bally CMP/CMS).

The GMU system component has a connection to the base game through a serial SAS connection and is connected to various servers using, for example, HTTPs over Ethernet. Through this connection, firmware, media, operating system software, gaming machine configurations can be downloaded to the system components from the servers. This data is authenticated prior to install on the system components.

The system components include the iView processing board and game monitoring unit (GMU) processing board. The GMU and iView can combined into one like the commercially available Bally GTM iView device. This device may have a video mixing technology to mix the EGM processor's video signals with the iView display onto the top box monitor or any monitor on the gaming device.

In the example embodiment, GMU 607 and/or PIB 609 are configured to transmit and receive data with the management computing device 106 (shown in FIG. 1). In particular, GMU 607 and/or PIB 609 may transmit messages indicating the operational state, status, events and/or other data associated with the gaming machine to the management computing device 106, and the management computing device 106 may transmits commands, such as operational state commands, and/or other data to GMU 607 and/or PIB 609. These commands are in a data format recognized by GMU 607 and/or PIB 609 and cause GMU 607 and/or PIB 609 to execute instruction to facilitate an operational state transition. The operational state transition may include selectively enabling, disabling, or otherwise changing operation of hardware and/or software of the gaming machine. In one example, input devices such as the soft keys 665 may be disabled. In another example, the card reader 655 may accept cards, but the card data may not be read or transmitted to networked server systems.

Figure 7:
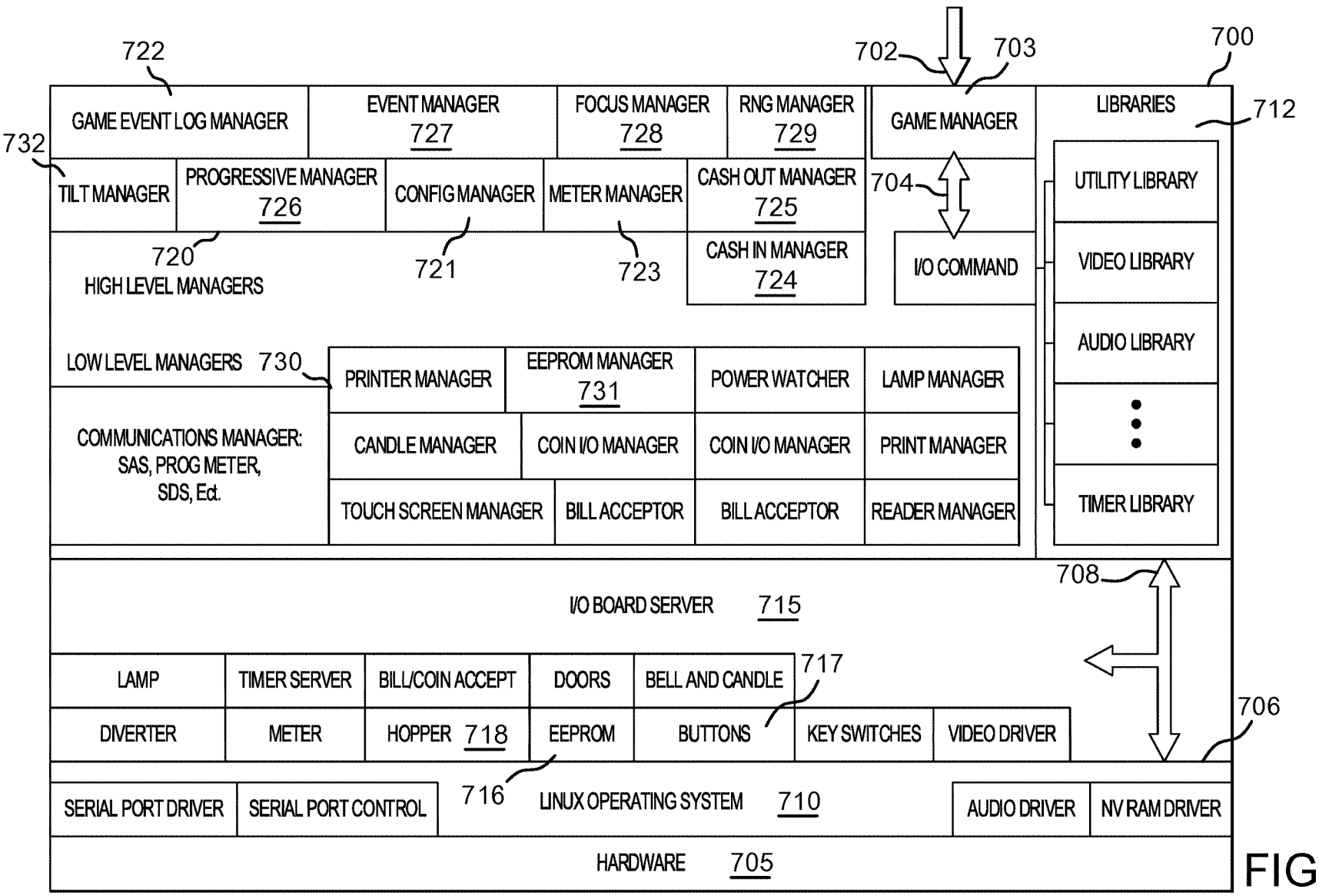
FIG. 7 is a block diagram of the logical components of a gaming kernel in accordance with one or more embodiments.

In accordance with one or more embodiments, FIG. 7 is a functional block diagram of a gaming kernel 700 of a game program under control of base game integrated circuit board 603. The game program uses gaming kernel 700 by calling into application programming interface (API) 702, which is part of game manager 703. The components of game kernel 700 as shown in FIG. 7 are only illustrative, and should not be considered limiting. For example, the number of managers may be changed, additional managers may be added or some managers may be removed without deviating from the scope and spirit of the invention.

As shown in the example, there are three layers: a hardware layer 705; an operating system layer 710, such as, but not limited to, Linux; and a game kernel layer 700 having game manager 703 therein. The operational states of a gaming machine may be defined by one or more parameters over the three layers. As a result, the enable and disable commands may change, disable, or enable these parameters accordingly. In one or more embodiments, the use of a standard operating system 710, such a UNIX-based or Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel layer 700 executes at the user level of the operating system 710, and itself contains a major component called the I/O Board Server 715. To properly set the bounds of game application software (making integrity checking easier), all game applications interact with gaming kernel 700 using a single API 702 in game manager 703. This enables game applications to make use of a well-defined, consistent interface, as well as making access points to gaming kernel 700 controlled, where overall access is controlled using separate processes.

For example, game manager 703 parses an incoming command stream and, when a command dealing with I/O comes in (arrow 704), the command is sent to an applicable library routine 712. Library routine 712 decides what it needs from a device, and sends commands to I/O Board Server 715 (see arrow 708). A few specific drivers remain in operating system 710's kernel, shown as those below line 706. These are built-in, primitive, or privileged drivers that are (i) general (ii) kept to a minimum and (iii) are easier to leave than extract. In such cases, the low-level communications is handled within operating system 710 and the contents passed to library routines 712.

Thus, in a few cases library routines may interact with drivers inside operating system 710, which is why arrow 708 is shown as having three directions (between library utilities 712 and I/O Board Server 715, or between library utilities 712 and certain drivers in operating system 710). No matter which path is taken, the logic needed to work with each device is coded into modules in the user layer of the diagram. Operating system 710 is kept as simple, stripped down, and common across as many hardware platforms as possible. The library utilities and user-level drivers change as dictated by the game cabinet or game machine in which it will run. Thus, each game cabinet or game machine may have an base game integrated circuit board 603 connected to a unique, relatively dumb, and as inexpensive as possible I/O adapter board 640, plus a gaming kernel 700 which will have the game-machine-unique library routines and I/O Board Server 715 components needed to enable game applications to interact with the gaming machine cabinet. Note that these differences are invisible to the game application software with the exception of certain functional differences (i.e., if a gaming cabinet has stereo sound, the game application will be able make use of API 702 to use the capability over that of a cabinet having traditional monaural sound).

Game manager 703 provides an interface into game kernel 700, providing consistent, predictable, and backwards compatible calling methods, syntax, and capabilities by way of game application API 702. This enables the game developer to be free of dealing directly with the hardware, including the freedom to not have to deal with low-level drivers as well as the freedom to not have to program lower level managers 730, although lower level managers 630 may be accessible through game manager 703's interface 702 if a programmer has the need. In addition to the freedom derived from not having to deal with the hardware level drivers and the freedom of having consistent, callable, object-oriented interfaces to software managers of those components (drivers), game manager 703 provides access to a set of upper level managers 720 also having the advantages of consistent callable, object-oriented interfaces, and further providing the types and kinds of base functionality required in casino-type games. Game manager 703, providing all the advantages of its consistent and richly functional interface 702 as supported by the rest of game kernel 700, thus provides a game developer with a multitude of advantages.

Game manager 703 may have several objects within itself, including an initialization object (not shown). The initialization object performs the initialization of the entire game machine, including other objects, after game manager 703 has started its internal objects and servers in appropriate order. In order to carry out this function, the kernel's configuration manager 721 is among the first objects to be started; configuration manager 721 has data needed to initialize and correctly configure other objects or servers.

The upper level managers 720 of game kernel 700 may include game event log manager 722 which provides, at the least, a logging or logger base class, enabling other logging objects to be derived from this base object. The logger object is a generic logger; that is, it is not aware of the contents of logged messages and events. The log manager's (722) job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 723 manages the various meters embodied in the game kernel 700. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 723 receives its initialization data for the meters, during start-up, from configuration manager 721. While running, the cash in (724) and cash out (725) managers call the meter manager's (723) update functions to update the meters. Meter manager 723 will, on occasion, create backup copies of the soft meters by storing the soft meters' readings in EEPROM. This is accomplished by calling and using EEPROM manager 731.

In accordance with still other embodiments, progressive manager 726 manages progressive games playable from the game machine. Event manager 727 is generic, like log manager 722, and is used to manage various gaming machine events. Focus manager 628 correlates which process has control of various focus items. Tilt manager 732 is an object that receives a list of errors (if any) from configuration manager 721 at initialization, and during game play from processes, managers, drivers, etc. that may generate errors. Random number generator manager 729 is provided to allow easy programming access to a random number generator (RNG), as a RNG is required in virtually all casino-style (gambling) games. RNG manager 729 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 725 has the responsibility of configuring and managing monetary output devices. During initialization, cash out manager 725, using data from configuration manager 721, sets the cash out devices correctly and selects any selectable cash out denominations. During play, a game application may post a cash out event through the event manager 727 (the same way all events are handled), and using a call-back posted by cash out manager 725, cash out manager 725 is informed of the event. Cash out manager 725 updates the credit object, updates its state in non-volatile memory, and sends an appropriate control message to the device manager that corresponds to the dispensing device. As the device dispenses dispensable media, there will typically be event messages being sent back and forth between the device and cash out manager 725 until the dispensing finishes, after which cash out manager 725, having updated the credit manager and any other game state (such as some associated with meter manager 723) that needs to be updated for this set of actions, sends a cash out completion event to event manager 727 and to the game application thereby. Cash in manager 624 functions similarly to cash out manager 725, only controlling, interfacing with, and taking care of actions associated with cashing in events, cash in devices, and associated meters and crediting.

In a further example, in accordance with one or more embodiments, I/O server 715 may write data to the gaming machine EEPROM memory, which is located in the gaming machine cabinet and holds meter storage that must be kept even in the event of power failure. Game manager 703 calls the I/O library functions to write data to the EEPROM. The I/O server 715 receives the request and starts a low priority EEPROM thread 716 within I/O server 715 to write the data. This thread uses a sequence of 8 bit command and data writes to the EEPROM device to write the appropriate data in the proper location within the device. Any errors detected will be sent as IPC messages to game manager 703. All of this processing is asynchronous.

In accordance with one embodiment, button module 717 within I/O server 715, polls (or is sent) the state of buttons every 2 ms. These inputs are debounced by keeping a history of input samples. Certain sequences of samples are required to detect a button was pressed, in which case the I/O server 715 sends an inter-process communication event to game manager 703 that a button was pressed or released. In some embodiments, the gaming machine may have intelligent distributed I/O which debounces the buttons, in which case button module 717 may be able to communicate with the remote intelligent button processor to get the button events and simply relay them to game manager 703 via IPC messages. In still another embodiment, the I/O library may be used for pay out requests from the game application. For example, hopper module 718 must start the hopper motor, constantly monitor the coin sensing lines of the hopper, debounce them, and send an IPC message to the game manager 703 when each coin is paid.

Further details, including disclosure of lower level fault handling and/or processing, are included in U.S. Pat. No. 7,351,151 entitled "Gaming Board Set and Gaming Kernel for Game Cabinets" and provisional U.S. patent application No. 60/313,743, entitled "Form Fitting Upgrade Board Set For Existing Game Cabinets," filed Aug. 20, 2001; said patent and provisional are both fully incorporated herein by explicit reference.

Figure 8A:
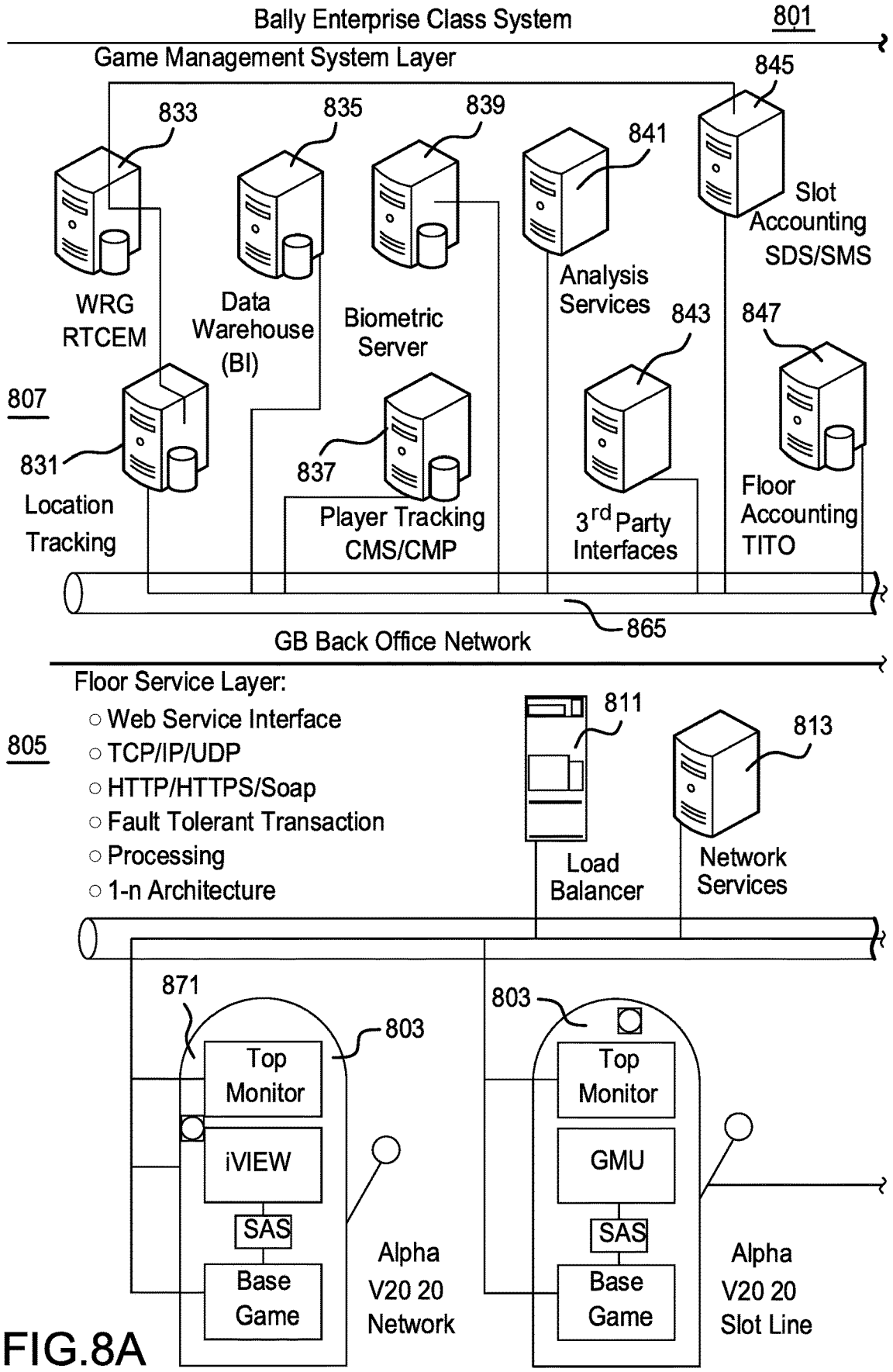
FIGS. 8A and 8B are a schematic block diagram showing the hardware elements of a networked gaming system in accordance with one or more embodiments.
Figure 8B:
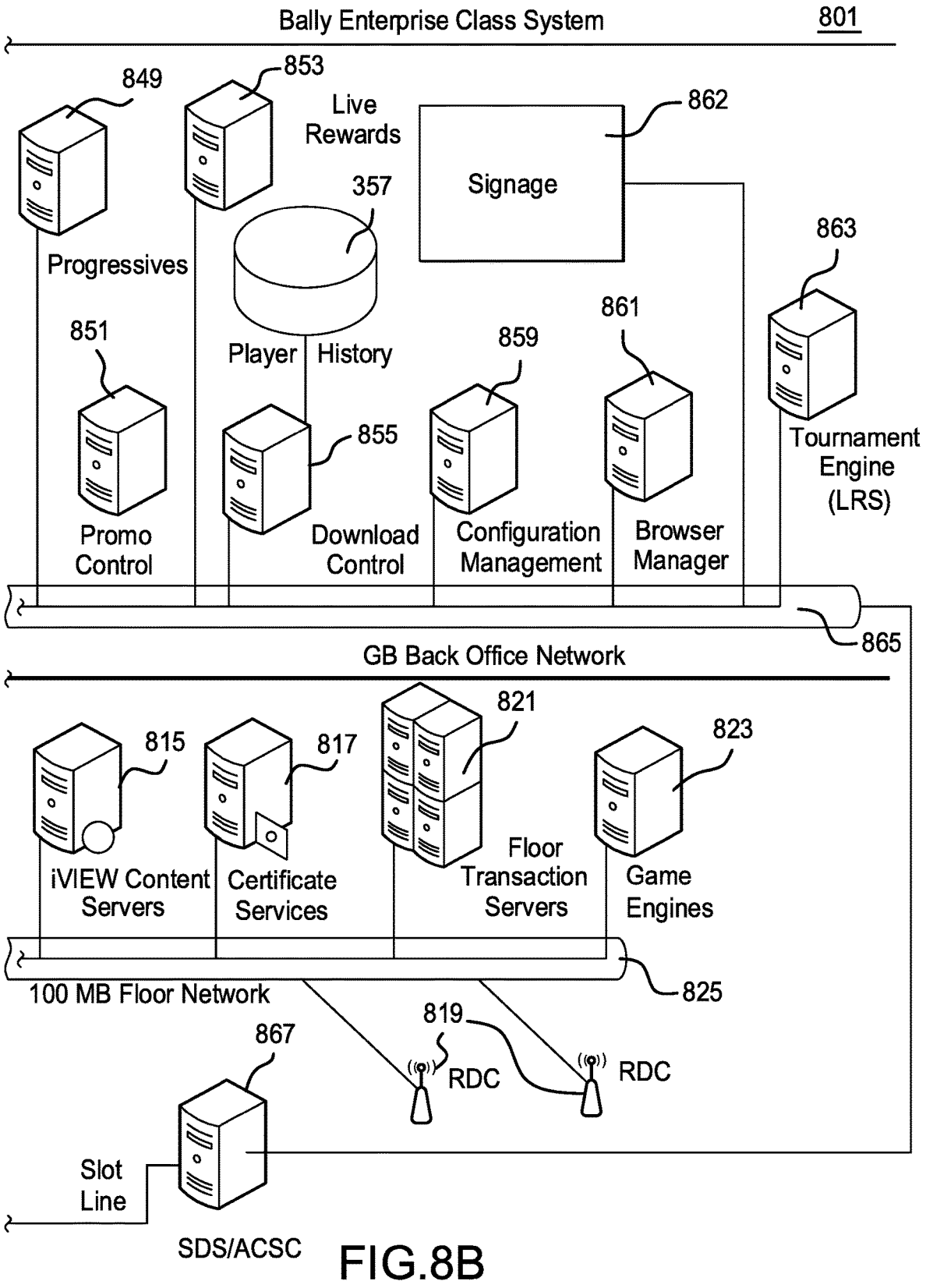

Referring to FIGS. 8A and 8B, enterprise gaming system 801 is shown in accordance with one or more embodiments. Enterprise gaming system 801 may include one casino or multiple locations and generally includes a network of gaming machines 803, floor management system (SMS) 805, and casino management system (CMS) 807. SMS 805 may include load balancer 811, network services servers 813, player interface (iView) content servers 815, certificate services server 817, floor radio dispatch receiver/transmitters (RDC) 819, floor transaction servers 821 and game engines 823, each of which may connect over network bus 825 to gaming machines 803. CMS 807 may include location tracking server 831, WRG RTCEM server 833, data warehouse server 835, player tracking server 837, biometric server 839, analysis services server 841, third party interface server 843, slot accounting server 845, floor accounting server 847, progressives server 849, promo control server 851, feature game (such as Bally Live Rewards) server 853, download control server 855, player history database 857, configuration management server 859, browser manager 861, tournament engine server 863 connecting through bus 865 to server host 867 and gaming machines 803. The various servers and gaming machines 803 may connect to the network with various conventional network connections (such as, for example, USB, serial, parallel, RS485, Ethernet). Additional servers which may be incorporated with CMS 807 include a responsible gaming limit server (not shown), advertisement server (not shown), and a control station server (not shown) where an operator or authorized personnel may select options and input new programming to adjust each of the respective servers and gaming machines 803. SMS 805 may also have additional servers including a control station (not shown) through which authorized personnel may select options, modify programming, and obtain reports of the connected servers and devices, and obtain reports. The management computing device 106 (shown in FIG. 1) may be incorporated into SMS 805, CMS 807, or another suitable network (including networks dedicated to the management computing device 106 and the gaming machines). The management computing device 106 may be incorporated within one of the servers shown in FIGS. 8A and 8B (e.g., configuration management server 859), or the management computing device 106 may be a separate device communicatively coupled to the corresponding network. The various CMS and SMS servers are descriptively entitled to reflect the functional executable programming stored thereon and the nature of databases maintained and utilized in performing their respective functions.

Gaming machines 803 include various peripheral components that may be connected with USB, serial, parallel, RS-485 or Ethernet devices/architectures to the system components within the respective gaming machine. The GMU has a connection to the base game through a serial SAS connection. The system components in the gaming cabinet may be connected to the servers using HTTPs or G2S over Ethernet. Using CMS 807 and/or SMS 805 servers and devices, firmware, media, operating systems, and configurations may be downloaded to the system components of respective gaming machines for upgrading or managing floor content and offerings in accordance with operator selections or automatically depending upon CMS 807 and SMS 805 master programming. The data and programming updates to gaming machines 803 are authenticated using conventional techniques prior to install on the system components.

In various embodiments, any of the gaming machines 803 may be a mechanical reel spinning slot machine or a video slot machine or a gaming machine offering one or more of the above described games including a group play game. Alternately, gaming machines 803 may provide a game with a simulated musical instrument interface as a primary or base game or as one of a set of multiple primary games selected for play by a random number generator. A gaming system of the type described above also allows a plurality of games in accordance with the various embodiments of the invention to be linked under the control of a group game server (not shown) for cooperative or competitive play in a particular area, carousel, casino or between casinos located in geographically separate areas. For example, one or more examples of group games under control of a group game server are disclosed in U.S. application Ser. No. 11/938,079, entitled "Networked System and Method for Group Play Gaming," filed on Nov. 9, 2007, which is hereby incorporated by reference in its entirety for all purposes.

Although the foregoing systems and methods are described as beneficial for social distancing measures, it is to be understood that the functions of the foregoing systems and methods may be used for other purposes. For example, the foregoing systems and methods may be used for maintenance scheduling of the gaming machines. In such embodiments, suitable data other than the initiation and conclusion of gaming sessions may be used to determine whether or not disable and/or enable commands are to be transmitted to the gaming machines. Moreover, the association between gaming machines may not be limited physical distance, but may also include the machine type, game type, and the like.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A gaming system comprising:

a plurality of gaming machines configured to conduct one or more games; and a management computing device communicatively coupled to the plurality of gaming machines, the management computing device configured to:

receive indication of a gaming session initiating at a first gaming machine of the plurality of gaming machines;

identify one or more gaming machines associated with the first gaming machine from the plurality of gaming machines;

transmit a disable command to the one or more associated gaming machines, the disable command configured to prevent the one or more gaming machines from initiating gaming sessions;

in response to determining that the gaming session at the first gaming machine has concluded, transmit an enable command to the one or more associated gaming machines, the enable command configured to enable the one or more gaming machines to initiate gaming sessions;

prevent the first gaming machine from initiating a subsequent gaming session and cause the first gaming machine to visually present a confirmation code; and in response to receiving the confirmation code from a device other than the first gaming machine to indicate that the first gaming machine has been sanitized, transmit the enable command to the first gaming machine, wherein the enable command causes the first gaming machine to permit the subsequent gaming session to be initiated.

2. The gaming system of claim 1, wherein the management computing device is configured to:

determine, in response to receiving indication of the gaming session initiating at the first gaming machine, whether or not any of the one or more associated gaming machines have an active gaming session; and in response to determining that the one or more associated gaming machines having no active gaming sessions, transmit the disable command to the one or more associated gaming machines.

3. The gaming system of claim 2, wherein the management computing device is configured to terminate, in response to determining at least one of the one or more associated gaming machines having an active gaming session prior to the gaming session initiated at the first gaming machine, the gaming session at the first gaming machine.

4. The gaming system of claim 1, wherein the management computing device is configured to transmit a sanitization request to an operator computing device, the sanitization request identifying the first gaming machine for sanitization, wherein the confirmation code is retrieved by the operator computing device from the visual presentation of the confirmation code by the first gaming machine and transmitted to the management computing device.

5. The gaming system of claim 1, wherein the association between the first gaming machine and the one or more gaming machines is based on the one or more gaming machines being within a threshold distance to the first gaming machine.

6. The gaming system of claim 5, wherein identifying the associated one or more gaming machines includes performing a lookup in a gaming machine database configured to link each gaming machine of the plurality of gaming machine to physically proximate ones of the plurality of gaming machines.

7. The gaming system of claim 5, wherein the management computing device is configured to:

retrieve a map of a gaming environment, the map indicating a location of each gaming machine of the plurality of gaming machines within the gaming environment;

establish an area of interest including an area surrounding the first gaming machine based at least partially on the threshold distance; and identify the one or more gaming machines associated with the first gaming machine by determining the one or more gaming machines are within the area of interest.

8. A method for managing a plurality of gaming machines using a management computing device in communication with the plurality of gaming machines, the method comprising:

receiving, by logic circuitry of the management computing device, indication of a gaming session initiating at a first gaming machine of the plurality of gaming machines;

identifying, by the logic circuitry, one or more gaming machines associated with the first gaming machine from the plurality of gaming machines;

transmitting, by the logic circuitry, a disable command to the one or more associated gaming machines, the disable command configured to prevent the one or more gaming machines from initiating gaming sessions;

in response to determining that the gaming session at the first gaming machine has concluded, transmitting, by the logic circuitry, an enable command to the one or more associated gaming machines, the enable command configured to enable the one or more gaming machines to initiate gaming sessions;

preventing, by the logic circuitry, the first gaming machine from initiating a subsequent gaming session and causing the first gaming machine to visually present a confirmation code; and transmitting, by the logic circuitry and in response to receiving the confirmation code from a device other than the first gaming machine to indicate that the first gaming machine has been sanitized, the enable command to the first gaming machine, wherein the enable command causes the first gaming machine to permit the subsequent gaming session to be initiated.

9. The method of claim 8, wherein transmitting the disable command further comprises:

in response to receiving indication of the gaming session initiating at the first gaming machine, determining, by the logic circuitry, whether or not any of the one or more associated gaming machines have an active gaming session; and in response to determining that the one or more associated gaming machines having no active gaming sessions, transmitting, by the logic circuitry, the disable command to the one or more associated gaming machines.

10. The method of claim 9 further comprising terminating, by the logic circuitry and in response to determining at least one of the one or more associated gaming machines having an active gaming session prior to the gaming session initiated at the first gaming machine, the gaming session at the first gaming machine.

11. The method of claim 8 further comprising transmitting, by the logic circuitry, a sanitization request to an operator computing device, the sanitization request identifying the first gaming machine for sanitization, wherein the confirmation code is retrieved by the operator computing device from the visual presentation of the confirmation code by the first gaming machine and transmitted to the management computing device.

12. The method of claim 8, wherein the association between the first gaming machine and the one or more gaming machines is based on the one or more gaming machines being within a threshold distance to the first gaming machine.

13. The method of claim 12, wherein identifying the associated one or more gaming machines includes performing a lookup in a gaming machine database configured to link each gaming machine of the plurality of gaming machine to physically proximate ones of the plurality of gaming machines.

14. The method of claim 12, wherein identifying the one or more gaming machines associated with the first gaming machine further comprises:

retrieving, by the logic circuitry, a map of a gaming environment, the map indicating a location of each gaming machine of the plurality of gaming machines within the gaming environment;

establishing, by the logic circuitry, an area of interest including an area surrounding the first gaming machine based at least partially on the threshold distance; and identifying, by the logic circuitry, the one or more gaming machines associated with the first gaming machine by determining the one or more gaming machines are within the area of interest.

15. A management computing device in communication with a plurality of gaming machines, the management computing device comprising logic circuitry configured to:

receive indication of a gaming session initiating at a first gaming machine of the plurality of gaming machines;

identify one or more gaming machines associated with the first gaming machine from the plurality of gaming machines;

transmit a disable command to the one or more associated gaming machines, the disable command configured to prevent the one or more gaming machines from initiating gaming sessions;

in response to determining that the gaming session at the first gaming machine has concluded, transmit an enable command to the one or more associated gaming machines, the enable command configured to enable the one or more gaming machines to initiate gaming sessions;

prevent the first gaming machine from initiating a subsequent gaming session and cause the first gaming machine to visually present a confirmation code; and in response to receiving the confirmation code from a device other than the first gaming machine to indicate that the first gaming machine has been sanitized, transmit the enable command to the first gaming machine, wherein the enable command causes the first gaming machine to permit the subsequent gaming session to be initiated.

16. The management computing device of claim 15, wherein the logic circuitry is configured to:

determine, in response to receiving indication of the gaming session initiating at the first gaming machine, whether or not any of the one or more associated gaming machines have an active gaming session; and in response to determining that the one or more associated gaming machines having no active gaming sessions, transmit the disable command to the one or more associated gaming machines.

17. The management computing device of claim 16, wherein the management computing device is configured to terminate, in response to determining at least one of the one or more associated gaming machines having an active gaming session prior to the gaming session initiated at the first gaming machine, the gaming session at the first gaming machine.

18. The management computing device of claim 15, wherein the logic circuitry is configured to transmit a sanitization request to an operator computing device, the sanitization request identifying the first gaming machine for sanitization, wherein the confirmation code is retrieved by the operator computing device from the visual presentation of the confirmation code by the first gaming machine and transmitted to the management computing device.

19. The management computing device of claim 15, wherein the association between the first gaming machine and the one or more gaming machines is based on the one or more gaming machines being within a threshold distance to the first gaming machine.

20. The management computing device of claim 19, wherein identifying the associated one or more gaming machines includes performing a lookup in a gaming machine database configured to link each gaming machine of the plurality of gaming machine to physically proximate ones of the plurality of gaming machines.

21. The management computing device of claim 19, wherein the logic circuitry is configured to:

retrieve a map of a gaming environment, the map indicating a location of each gaming machine of the plurality of gaming machines within the gaming environment;

establish an area of interest including an area surrounding the first gaming machine based at least partially on the threshold distance; and identify the one or more gaming machines associated with the first gaming machine by determining the one or more gaming machines are within the area of interest.

* * * * *